US009348252B2

(12) United States Patent
Higuchi et al.

(10) Patent No.: US 9,348,252 B2
(45) Date of Patent: May 24, 2016

(54) IMAGE FORMING APPARATUS

(71) Applicant: Brother Kogyo Kabushiki Kaisha, Nagoya-shi, Aichi-ken (JP)

(72) Inventors: Takayuki Higuchi, Anpachi-gun (JP); Tomoaki Hattori, Nagoya (JP); Jun Ikami, Nagoya (JP); Kumiko Suzuki, Gifu (JP); Emi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/866,034

(22) Filed: Sep. 25, 2015

(65) Prior Publication Data

US 2016/0011537 A1 Jan. 14, 2016

Related U.S. Application Data

(63) Continuation of application No. PCT/JP2014/058555, filed on Mar. 26, 2014.

(30) Foreign Application Priority Data

Mar. 26, 2013 (JP) ..... 2013-064718

(51) Int. Cl.

| | |
|---|---|
| ***G03G 15/04*** | (2006.01) |
| ***G03G 15/20*** | (2006.01) |
| ***G03G 9/09*** | (2006.01) |

(52) U.S. Cl.

CPC ..... *G03G 15/04045* (2013.01); *G03G 9/0926* (2013.01); *G03G 9/0928* (2013.01); *G03G 15/2007* (2013.01); *G03G 15/2021* (2013.01); *G03G 15/2064* (2013.01)

(58) Field of Classification Search

CPC ..... G03G 15/04045; G03G 15/20; G03G 15/2064

See application file for complete search history.

(56) References Cited

U.S. PATENT DOCUMENTS

| | | | |
|---|---|---|---|
| 4,840,863 | A | 6/1989 | Otsu et al. |
| 7,398,044 | B2 | 7/2008 | Masuda et al. |
| 8,718,527 | B2 | 5/2014 | Kageyama |
| 8,933,208 | B2 | 1/2015 | Norikane et al. |

(Continued)

FOREIGN PATENT DOCUMENTS

| | | | |
|---|---|---|---|
| JP | S63-60458 | A | 3/1988 |
| JP | H03-125158 | A | 5/1991 |

(Continued)

OTHER PUBLICATIONS

Aug. 5, 2014—International Search Report—Intl App PCT/JP2014/058555.

(Continued)

*Primary Examiner* — W B Perkey

(74) *Attorney, Agent, or Firm* — Banner & Witcoff, Ltd.

(57) ABSTRACT

An image forming apparatus has a photosensitive member configured to transport a developer containing a compound that causes cis-trans isomerization reaction by light absorption to induce phase transition; a first exposure device configured to emit ultraviolet light having a wavelength of 300 nm-400 nm to a developer image; and a pressing member configured to press a recording sheet holding a developer image exposed by the first exposure device thereon. It is possible to achieve conservation of energy during image formation.

27 Claims, 7 Drawing Sheets

(56) References Cited

U.S. PATENT DOCUMENTS

| | | | | |
|---|---|---|---|---|
| 2002/0094220 | A1* | 7/2002 | Bartscher | G03G 15/2007 399/341 |
| 2005/0084302 | A1 | 4/2005 | Masuda et al. | |
| 2008/0032225 | A1* | 2/2008 | Teshima | G03G 9/12 430/114 |
| 2011/0177450 | A1* | 7/2011 | Uekawa | G03G 15/20 430/124.22 |
| 2011/0236821 | A1* | 9/2011 | Kageyama | G03G 15/201 430/124.1 |
| 2013/0066068 | A1 | 3/2013 | Norikane et al. | |

FOREIGN PATENT DOCUMENTS

| | | | |
|---|---|---|---|
| JP | H03-175456 | A | 7/1991 |
| JP | H03-243954 | A | 10/1991 |
| JP | H07-13449 | A | 1/1995 |
| JP | H10-151793 | A | 6/1998 |
| JP | H11-15192 | A | 1/1999 |
| JP | H11-202671 | A | 7/1999 |
| JP | 2003-330228 | A | 11/2003 |
| JP | 2005-091545 | A | 4/2005 |
| JP | 2011-209318 | A | 10/2011 |
| JP | 2011-256155 | A | 12/2011 |
| JP | 2011-256291 | A | 12/2011 |

OTHER PUBLICATIONS

Aug. 5, 2014—(WO) Written Opinion of the ISA, Eng Tran.

* cited by examiner

IMAGE FORMING APPARATUS

CROSS-REFERENCES TO RELATED APPLICATIONS

This application is a Continuation Application of International Application No. PCT/JP2014/058555 which was filed on Mar. 26, 2014 claiming the conventional priority of Japanese patent Application No. 2013-064718 filed on Mar. 26, 2013, and the disclosures of International Application No. PCT/JP2014/058555 and Japanese patent Application No. 2013-064718 are incorporated herein by reference in their entireties.

BACKGROUND OF THE INVENTION

1. Field of the Invention

The present invention relates to an image forming apparatus employing an electrophotographic system.

2. Description of the Related Art

There has been conventionally known an image forming apparatus in an electrophotographic system that forms an image with a developer such as toner.

As such an image forming apparatus, for example, there has been known a printer including: a photosensitive drum carrying a toner image thereon; and a heat fixing device fixing onto a paper a toner image transferred from the photosensitive drum to the paper, in which the heat fixing device includes: a heating roller; and a pressing roller (see Japanese Patent Application Laid-open No. 2005-91545, for example).

Then, in such a printer, at the time of image formation, the heating roller is heated to a surface temperature of 175° C. or higher, for example, and when the paper passes through the space between the heating roller and the pressing roller, the toner image on the paper is heat fixed.

SUMMARY

That is, in the printer described in Japanese Patent Application Laid-open No. 2005-91545, when fixing toner to the paper, it is necessary to melt the toner on the paper once by heating it to high temperature. Therefore, there is a limit to achievement of conservation of energy.

Then, an object of the present teaching is to provide an image forming apparatus capable of achieving conservation of energy during image formation.

(1) In order to achieve the above-described object, the image forming apparatus of the present teaching is an image forming apparatus includes: a photosensitive member configured to transport a developer containing a compound that causes cis-trans isomerization reaction by light absorption to induce phase transition; a first exposure device configured to emit ultraviolet light having a wavelength of 300 nm or more to less than 400 nm to a developer image; and a pressing member configured to press a recording sheet holding a developer image exposed by the first exposure device thereon.

According to such a configuration, since the developer contains the compound that causes cis-trans isomerization reaction by light absorption to induce phase transition, by emitting light having a predetermined wavelength to the developer, the compound can be melted or solidified. Particularly, the developer contains the compound that absorbs ultraviolet light having a wavelength of 300 nm or more to less than 400 nm to be fluidized, and therefore the compound is melted to then be solidified, thereby making it possible to fix the developer to the recording sheet. As a result, it is possible to achieve conservation of energy as compared to the case where when fixing a developer to a recording sheet, heating is needed for melting the developer.

Further, the pressing member presses the recording sheet holding the developer image exposed by the first exposure device thereon. Therefore, it is possible to make the developer image adhere closely to the recording sheet, and furthermore it is possible to achieve an improvement in fixation of the developer image to the recording sheet.

Consequently, according to the image forming apparatus of the present teaching, it is possible to achieve an improvement in fixation of the developer image to the recording sheet while being able to achieve conservation of energy during image forming operation, specifically, when the developer is fixed to the recording sheet.

(2) Further, the image forming apparatus may include a second exposure device configured to emit visible light having a wavelength of not less than 400 nm nor more than 800 nm to the developer image to which the ultraviolet light has been emitted. According to such a configuration, the visible light from the second exposure device can be emitted to the developer image to which the ultraviolet light from the first exposure device has been emitted. That is, it is possible to emit visible light to the compound melted by the ultraviolet light emission. Therefore, it is possible to securely solidify the compound melted once.

(3) Further, the first exposure device may be configured to expose a developer image transferred onto the recording sheet.

According to such a configuration, since the first exposure device can expose the developer image transferred onto the recording sheet, it is possible to securely fix the developer image to the recording sheet.

(4) The image forming apparatus may further include a transportation belt for transporting a recording sheet, and the transportation belt may be formed of a material transmitting the ultraviolet light. By such a configuration, the ultraviolet light can be emitted through the transportation belt, and the first exposure device can be accommodated in the space around which the transportation belt moves.

(5) Further, the image forming apparatus may further include an intermediate transfer member configured to transport a developer image on the photosensitive member to the recording sheet. In this case, the first exposure device is configured to expose a developer image on the intermediate transfer member. According to such a configuration, the first exposure device exposes the developer image on the intermediate transfer member, thereby making it possible to melt the compound contained in the developer on the intermediate transfer member. Therefore, when the developer containing the melted compound is transported by the intermediate transfer member to come into contact with the recording sheet, the melted compound adheres closely to the sheet. Therefore, it is possible to securely transfer the developer image onto the recording sheet from the intermediate transfer member.

(6) Further, the second exposure device may be configured to expose the developer image on the intermediate transfer member from the inside of a space surrounded by the intermediate transfer member. According to such a configuration, since the second exposure device is arranged in the inside around the intermediate transfer member, it is possible to ensure efficient arrangement of the second exposure device and the intermediate transfer member as compared to the case where the second exposure device is arranged outside the intermediate transfer member.

Further, the second exposure device is provided in the space surrounded by the intermediate transfer member, to therefore emit visible light to the portion of the developer image on the intermediate transfer member side. Thereby, of the developer image on the intermediate transfer member, the compound in the portion in contact with the intermediate transfer member is solidified. Therefore, it is possible to achieve an improvement in removability of the developer image from the intermediate transfer member when the developer image is transferred onto the recording sheet from the intermediate transfer member.

(7) Further, the second exposure device may be arranged in the inside around the intermediate transfer member so as to face a surface, of the intermediate transfer member, on the side opposite to a surface onto which the developer image is transferred. According to such a configuration, the second exposure device faces the surface, of the intermediate transfer member, on the side opposite to the surface onto which the developer image is transferred, therefore making it possible to securely emit visible light to, of the developer image on the intermediate transfer member, the portion in contact with the intermediate transfer member.

(8) Further, the image forming apparatus may further include a heating member configured to heat a developer image transferred onto the recording sheet to fix the developer image to the recording sheet. According to such a configuration, the heating member can heat the developer image transferred onto the recording sheet, therefore making it possible to solidify the compound melted by the ultraviolet light emission from the first exposure device by the heating. As a result, it is possible to achieve a further improvement in fixation of the developer to the recording sheet.

(9) Further, the image forming apparatus may further include a transfer member configured to transfer a developer image on the photosensitive member onto the recording sheet from the photosensitive member. In this case, the photosensitive member is configured to transport the developer image to a contact position where the developer image and the recording sheet come into contact with each other. Further, the first exposure device is arranged on the upstream side in a transporting direction in which a recording sheet is transported with respect to the contact position, and is configured to emit ultraviolet light toward the contact position. According to such a configuration, the transfer member can securely transfer the developer image on the photosensitive member onto the recording sheet from the photosensitive member.

Further, since the first exposure device emits the ultraviolet light toward the contact position, the compound contained in the developer image existing at the contact position is melted. Therefore, when the developer image and the recording sheet come into contact with each other, the compound can be melted, resulting in that the developer image can be transferred onto the recording sheet further securely. Further, the second exposure device may be configured to emit visible light toward the contact position. According to such a configuration, the second exposure device emits the visible light toward the developer image existing at the contact position, thereby making it possible to solidify the melted compound at the contact position. That is, the compound contained in the developer image existing at the contact position is transferred onto the recording sheet by the transfer member, and is melted by the ultraviolet light emission from the first exposure device, and then is solidified immediately by the visible light emission from the second exposure device. Therefore, the compound is prevented from moving with the recording sheet in a melted state. As a result, it is possible to prevent a foreign matter from attaching to the melted compound.

(10) Further, the image forming apparatus may further include: an intermediate transfer member configured to transport a developer image on the photosensitive member; and a transfer member facing the intermediate transfer member and configured to transfer a developer image on the intermediate transfer member onto the recording sheet. The intermediate transfer member is configured to transport the developer image to the contact position where the developer image and the recording sheet come into contact with each other. Further, the first exposure device is arranged on the side opposite to the photosensitive member with respect to the contact position, and is configured to emit ultraviolet light toward the contact position. According to such a configuration, the image forming apparatus includes the transfer member, therefore making it possible to securely transfer the developer image on the intermediate transfer member onto the recording sheet from the intermediate transfer member.

Further, the first exposure device emits the ultraviolet light toward the contact position, thereby making it possible to melt the compound contained in the developer existing at the contact position. Therefore, when the developer image and the recording sheet come into contact with each other, the developer image can be transferred onto the recording sheet and the compound contained in the developer can be melted.

(11) Further, the image forming apparatus may further include a third exposure device configured to emit ultraviolet light having a wavelength of 300 nm or more to less than 400 nm to a developer image. In this case, the third exposure device is arranged on the side opposite to the first exposure device with respect to the recording sheet. According to such a configuration, since the third exposure device is arranged on the side opposite to the first exposure device with respect to the recording sheet, the developer image is arranged between the first exposure device and the third exposure device. Therefore, the ultraviolet light having the wavelength of 300 nm or more to less than 400 nm is emitted to the developer image from both sides. As a result, it is possible to securely melt the compound contained in the developer, and furthermore it is possible to securely achieve an improvement in fixation of the developer image to the recording sheet.

(12) Further, the image forming apparatus may further include a fourth exposure device configured to emit visible light having a wavelength of not less than 400 nm nor more than 800 nm to the developer image to which the ultraviolet light has been emitted. In this case, the second exposure device is arranged on the side opposite to the photosensitive member with respect to the recording sheet, and the fourth exposure device is arranged on the side opposite to the second exposure device with respect to the recording sheet sandwiched therebetween. According to such a configuration, the developer image existing at the contact position is arranged between the second exposure device and the fourth exposure device, and to the developer image, the visible light having the wavelength of not less than 400 nm nor more than 800 nm is emitted from both sides. That is, to the developer containing the compound melted by the ultraviolet light emission, the visible light having the wavelength of not less than 400 nm nor more than 800 nm is emitted from both sides. Therefore, it is possible to securely solidify the compound contained in the developer, and furthermore it is possible to further securely achieve an improvement in fixation of the developer image to the recording sheet.

(13) Further, the transfer member may include a heating mechanism to function as the heating member. According to such a configuration, the transfer member works also as the heating member, therefore being able to securely solidify the compound contained in the developer while being able to transfer the developer onto the recording sheet from the intermediate transfer member.

(14) Further, the transfer member may function as the pressing member. According to such a configuration, the transfer member functions also as the pressing member, therefore being able to make the compound contained in the developer adhere closely to the recording sheet securely while being able to transfer the developer onto the recording sheet from the intermediate transfer member.

The image forming apparatus of the present teaching may include a developer containing a compound causing cis-trans isomerization reaction by light absorption to induce phase transition. The developer contains a binder resin, a colorant, and an additive, and the additive can contain the compound. Further, the developer contains a binder resin and a colorant, and the binder resin may contain the compound. The compound can be a sugar alcohol ester or a discotic liquid crystalline compound.

According to the image forming apparatus of the present teaching, it is possible to achieve conservation of energy during image formation.

DESCRIPTION OF THE PREFERRED EMBODIMENTS

1. Configuration of Printer

Figure 1:
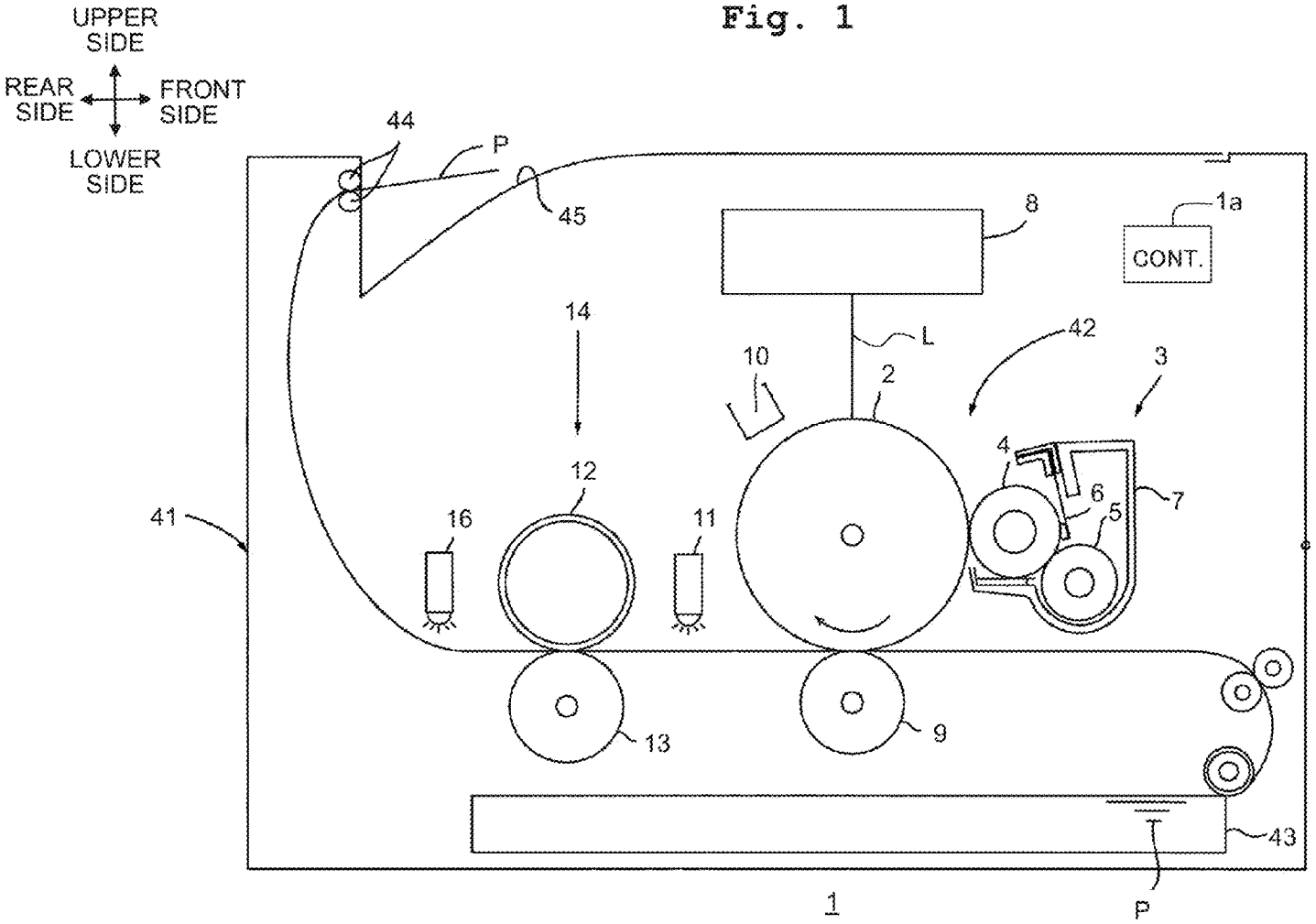
FIG. 1 is a central cross-sectional view of a printer as a first embodiment of an image forming apparatus of the present teaching.

A printer 1 as one example of an image forming apparatus includes a substantially box-shaped main body casing 41 as shown in FIG. 1. Incidentally, regarding the printer 1, directions are each referred to based on the directions when the printer 1 is placed horizontally, and specifically based on the arrow directions shown in FIG. 1.

Further, the printer 1 includes in the main body casing 41: an image forming unit 42; a fixing unit 14; and a control device 1A that controls them.

The image forming unit 42 includes: a photosensitive drum 2 as one example of a photosensitive member; a developing cartridge 3; a scanner unit 8; a scorotron charger 10; and a transfer roller 9 as one example of a transfer member.

The photosensitive drum 2 is formed to have a substantially cylindrical shape extending in the left-right direction, and is configured to rotate substantially clockwise as viewed on the left side. That is, the left-right direction is one example of the longitudinal direction of the photosensitive drum 2.

The developing cartridge 3 is arranged in front of the photosensitive drum 2, and includes a casing 7.

Further, the developing cartridge 3 includes: a developing roller 4; a supply roller 5; and a layer thickness regulating blade 6 in the casing 7. The developing roller 4 is arranged to be exposed from the rear side of the casing 7, rotatably supported by the casing 7, and is in contact with the photosensitive drum 2 from the front side. Incidentally, in an image forming operation to be described later, a developing bias is applied to the developing roller 4.

The supply roller 5 is arranged to press against the developing roller 4 from the front lower side, and is rotatably supported by the casing 7. The layer thickness regulating blade 6 is supported by the casing 7 to come into contact with the developing roller 4 from the front side. Then, the casing 7 accommodates toner as one example of a developer on/above the supply roller 5 in the inside thereof.

The scanner unit 8 is arranged above the photosensitive drum 2 with a space left therebetween at an upper portion inside the main body casing 41. Further, the scanner unit 8 emits a laser beam L based on image data toward the photosensitive drum 2 to expose a circumferential surface of the photosensitive drum 2.

The scorotron charger 10 is opposingly arranged on the rear upper side of the photosensitive drum 2 with a space left therebetween. The transfer roller 9 is pressed against the photosensitive drum 2 from below. Incidentally, in the image forming operation to be described later, a transfer bias is applied to the transfer roller 9.

The fixing unit 14 is arranged in rear of the image forming unit 42, and includes: an ultraviolet LED 11 as one example of a first exposure device; a heating roller 12 as one example of a heating member; a pressing roller 13; and a visible LED 16 as one example of a second exposure device. A paper feed tray 43 for accommodating a printing paper P as one example of a recording sheet is removably installed at a bottom portion in the main body casing 41. Further, various rollers are arranged in the vicinity of the paper feed tray 43.

The ultraviolet LED 11 is arranged on the transporting direction downstream side of the printing paper P with respect to an abutting position of the transfer roller 9 and the photosensitive drum 2. The ultraviolet LED 11 is arranged on the transporting direction upstream side of the printing paper P with respect to an abutting position of the pressing roller 13 and the heating roller 12. The ultraviolet LED 11 is arranged in rear of the photosensitive drum 2 with a space left therebetween. Further, the ultraviolet LED 11 is configured to emit ultraviolet light having a wavelength of, for example, 300 nm or more and preferably 330 nm or more, and for example, less than 400 nm and preferably less than 390 nm to the lower side. The wavelength of ultraviolet light that the ultraviolet LED 11 emits can be selected appropriately according to a wavelength necessary for cis-trans isomerization reaction of a compound which causes cis-trans isomerization reaction. Further, a light exposure of the ultraviolet LED 11 is, for example, 0.5 to 200 J/cm$^2$, preferably 1.0 to 150 J/cm$^2$, and further preferably 3.0 to 80 J/cm$^2$.

The heating roller 12 is arranged in rear of the ultraviolet LED 11 with a space left therebetween, and is configured so that a circumferential surface thereof is heated to, for example, 25 to 100° C. and preferably 40 to 80° C. during the image forming operation to be described later. The heating roller 12 includes a heating mechanism such as a heater, for example, in the inside thereof. The heating mechanism turns on/off a heating operation and adjusts a heating temperature according to a type of toner to be used and a use condition of the printer 1 by the control device 1A. Accordingly, the heating roller 12 also has a possibility of just functioning as a pressing member in cooperation with the pressing roller 13 without being heated. The pressing roller 13 is pressed against the heating roller 12 from below.

The visible LED 16 is arranged on the transporting direction downstream side of the printing paper P with respect to the abutting position of the heating roller 12 and the pressing roller 13. Further, the visible LED 16 is arranged in rear of the heating roller 12 with a space left therebetween. Further, the visible LED 16 is configured to emit visible light having a wavelength of, for example, 400 nm or more and preferably 450 nm or more and for example, 800 nm or less and preferably 650 nm or less to the lower side. The wavelength of visible light that the visible LED 16 emits can be selected appropriately according to a wavelength necessary for cis-trans isomerization reaction of a compound to cause cis-trans isomerization reaction. Incidentally, when a cis-trans isomerization reaction group is azobenzene, it is known that it absorbs ultraviolet light around 365 nm to isomerize to trans configuration, and absorbs visible light around 500 nm to return to cis configuration.

The visible LED 16 is configured to enable switching between on and off according to a type of toner to be used. The on/off controls of the heating roller 12 and the visible LED 16 may be performed by, for example, the control device 1A that controls the operation of the printer 1, or they may also be performed by an operation display (not shown) being a user interface of the printer 1. On the downstream side of the heating roller 12, paper discharge rollers 44 are provided, and on a top surface of the main body casing 41, a paper discharge tray 45 is formed.

2. Details of Toner

Examples of toner accommodated in the casing 7 include: a first toner in which UV softening material adheres to surfaces of toner base particles; a second toner in which UV softening material is contained in toner base particles as a binder resin, and the like, for example.

(1) First Toner

More specifically, the first toner includes: toner base particles as one example of developer base particles containing a binder resin and a colorant; and an additive to adhere to surfaces of the toner base particles.

The first toner as above is produced by undergoing an additive preparation step in which an additive suspension is prepared, a toner base particle preparation step in which a toner base particle suspension is prepared, and a toner preparation step in which toner is prepared from the additive suspension and the toner base particle suspension.

(1-1) Additive Preparation Step

In the additive preparation step, the additive suspension is first prepared.

The additive contains at least the UV softening material, and contains a charge control agent as necessary.

Therefore, in the additive preparation step, at least a UV softening material suspension is prepared, and as necessary, a charge control agent suspension is prepared separately from the UV softening material suspension.

(1-1-1) Preparation of UV Softening Material Suspension

The UV softening material suspension, namely a UV softening material suspension in which UV softening material microparticles are dispersed, is prepared in a manner that from a UV softening material emulsified liquid obtained by mixing a UV softening material, an organic solvent, and an aqueous medium and emulsifying the mixed resultant, the organic solvent is removed.

(1-1-2) UV Softening Material

The UV softening material contains a photo-reactive compound that causes cis-trans isomerization reaction by light absorption to induce phase transition. More specifically, the photo-reactive compound is a compound that induces phase transition by light absorption, and is a compound having a plurality of photoisomerizable functional groups, which are, for example, azobenzene groups, in a molecule, and induces a phase transition from a solid to a liquid by adsorbing light having a wavelength of 300 nm or more to less than 400 nm.

Examples of such a photo-reactive compound include a sugar alcohol ester represented by General Formula (1) below, a sugar alcohol ester represented by General Formula (2) below, a discotic liquid crystalline compound represented by General Formula (4) below, and the like, for example.

General Formula (1):

(1)

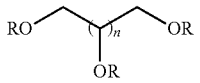

(In Formula (1), R represents a functional group represented by General Formula (3) below, and n is an integer of 1 to 4.)

General Formula (2):

(2)

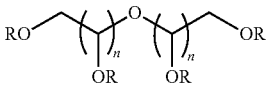

(In Formula (2), R represents a functional group represented by General Formula (3) below, and n is an integer of 1 to 4.)

General Formula (3):

(3)

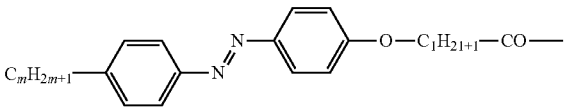

(In Formula (3), m is an integer of 0 to 16, and 1 is an integer of 1 to 16.)

General Formula (4):

(4)

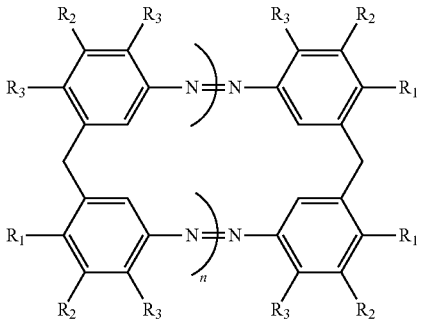

(In Formula (4), $R_1$, $R_2$, and $R_3$ are independently selected from the group consisting of hydrogen, an alkyl group, an alkoxyl group, an alkoxycarbonyl group, an alkoxycarbonyloxy group, an alkanoyl group, an alkanoyloxy group, an alkoxyphenyl group, and an N-alkylaminocarbonyl group, and n is an integer with the provision that the case where $R_1$, $R_2$, and $R_3$ are all hydrogen is excluded.)

(1-1-2-1) Sugar Alcohol Ester

The sugar alcohol esters represented by General Formula (1) above and General Formula (2) above each absorb light having a wavelength of 300 nm or more to less than 400 nm, to thereby induce a phase transition from a solid to a liquid, and further absorb light having a wavelength of not less than 400 nm nor more than 800 nm, or are heated to not lower than 30° C. nor higher than the melting point of the compound, to thereby induce a phase transition from a liquid to a solid.

In General Formula (3) above, m is preferably an integer of 4 to 8. Further, in General Formula (3) above, 1 is preferably an integer of 8 to 12.

The melting point of such sugar alcohol esters is, for example, 50° C. or higher and preferably 60° C. or higher, and for example, 140° C. or lower and preferably 130° C. or lower.

Such sugar alcohol esters may be used alone, or can also be used in combination of two or more types. Further, between such sugar alcohol esters, the sugar alcohol ester represented by General Formula (1) above is preferably cited, and sugar alcohol esters represented by Chemical Formula (5) to Chemical Formula (7) below are further preferably cited, and among them, the sugar alcohol ester represented by Chemical Formula (7) is preferably cited. When a photoisomerizable group in the compounds represented by Chemical Formula (5) to Chemical Formula (7) below is in a trans form, fluidity is lost, and when it is in a cis form, fluidity is given. When the photoisomerizable group is azobenzene, the photoisomerizable group isomerizes to a cis form when ultraviolet light around 365 nm is emitted thereto, and the photoisomerizable group is transformed to a trans form immediately when visible light around 500 nm is emitted thereto.

Chemical Formula (5):

(5)

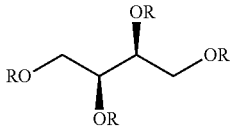

AzTh (In Formula (5), R represents a functional group represented by Chemical Formula (8) below.)

Chemical Formula (6):

(6)

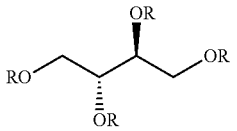

AzEr (In Formula (6), R represents a functional group represented by Chemical Formula (8) below.)

Chemical Formula (7):

(7)

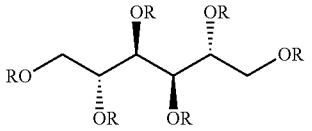

AzMn (In Formula (7), R represents a functional group represented by Chemical Formula (8) below.)

Chemical Formula (8):

(8)

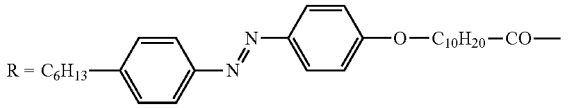

In order to prepare the sugar alcohol ester represented by General Formula (1) above, a raw material compound having an azobenzene group represented by General Formula (3) above and a sugar alcohol represented by General Formula (9) below are made to react with each other.

As the raw material compound, for example, an azobenzene compound represented by General Formula (10) below, and the like are cited.

General Formula (10):

(10)

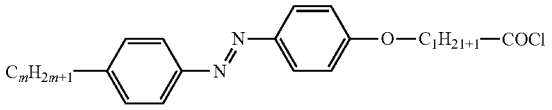

(In Formula (10), m is the same integer as that of m represented by General Formula (3) above, and 1 is the same integer as that of 1 represented by General Formula (3) above.)

The azobenzene compound represented by General Formula (10) above is prepared in a manner that for example, 4-alkyl-4'-hydroxyazobenzene and a halogen atom-containing carboxylic acid compound are made to react with each other under alkaline conditions to prepare a carboxyl group-containing azobenzene derivative as an intermediate, and then the carboxyl group-containing azobenzene derivative is made to react with an acid halogenating agent.

As the 4-alkyl-4'-hydroxyazobenzene, 4-hexyl-4'-hydroxyazobenzene is preferably cited.

The halogen atom-containing carboxylic acid compound is a compound having a carboxyl group and a halogen atom, and for example, a halogen atom-containing carboxylic acid compound having a number of carbons of 2 to 17 is cited, and preferably a halogen atom-containing carboxylic acid compound having a number of carbons of 9 to 13 is cited. Further, as the halogen atom of the halogen atom-containing carboxylic acid compound, for example, fluorine, chlorine, bromine, iodine, and the like are cited, and preferably the bromine is cited.

Further, as the acid halogenating agent, for example, thionyl chloride, oxalyl chloride, phosgene, phosphorus oxychloride, phosphorus pentachloride, phosphorus trichloride, thionyl bromide, phosphorus tribromide, diethylaminosulfur trifluoride, and the like are cited, and preferably the thionyl chloride is cited.

General Formula (9):

(9)

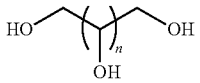

(In Formula (9), n is the same integer as that of n represented by General Formula (1) above.)

The sugar alcohol represented by General Formula (9) above is chain polyhydric alcohol in which the carboxyl group of sugar is reduced, and examples thereof include: trotyl such as glycerin, for example; tetrytol such as threitol or erythritol, for example; pentitol such as arabinitol, xylitol, or ribitol, for example; pentitol such as galactitol, glucitol, or mannitol, for example; and the like.

Such sugar alcohols may be used alone, or can also be used in combination of two or more types. Further, among such sugar alcohols, the pentitol is preferably cited, and the mannitol is further preferably cited.

In order to make the azobenzene compound represented by General Formula (10) above and the sugar alcohol represented by General Formula (9) above react with each other, first, the azobenzene compound represented by General Formula (10) above is dissolved in an organic solvent to prepare an intermediate solution, and the sugar alcohol represented by General Formula (9) above is dispersed in dehydrated pyridine, to thereby prepare, for example, 0.5 to 3 mass % of a sugar alcohol suspension.

Examples of the organic solvent include: esters such as, for example, ethyl acetate and butyl acetate; ethers such as, for example, diethyl ether, diisopropyl ether, and tetrahydrofuran; ketones such as, for example, acetone and methyl ethyl ketone; saturated hydrocarbons such as, for example, hexane and heptane; and halogenated hydrocarbons such as, for example, dichloromethane, dichloroethane, and carbon tetrachloride. Such organic solvents may be used alone, or can also be used in combination of two or more types. Further, among such organic solvents, the halogenated hydrocarbons are preferably cited, and the dichloromethane is further preferably cited.

Next, the sugar alcohol suspension is slowly added to the intermediate solution, to then be agitated for, for example, 24 to 144 hours at, for example, 10 to 40° C.

Thereby, the azobenzene compound represented by General Formula (10) above and the sugar alcohol represented by General Formula (9) above react with each other, and the sugar alcohol ester represented by General Formula (1) above is produced.

(1-1-2-2) Discotic Liquid Crystalline Compound

The discotic liquid crystalline compound represented by General Formula (4) above absorbs light having a wavelength of 300 nm or more to less than 400 nm, to thereby induce a phase transition from a solid to a liquid, and further the discotic liquid crystalline compound is heated to not lower than 30° C. nor higher than the melting point of the compound, to thereby induce a phase transition from a liquid to a solid.

In General Formula (4) above, as $R_1$, an alkoxyl group is preferably cited, further preferably an alkoxyl group having a number of carbon or carbons of 1 to 20 is cited, and still further preferably an alkoxyl group having a number of carbons of 8 to 16 is cited. Further, in General Formula (4) above, as $R_2$ and $R_3$, hydrogen is preferably cited. Further, in General Formula (4) above, n is an integer of 1 to 8, for example, and preferably an integer of 1 to 4.

The melting point of such discotic liquid crystalline compounds is, for example, 50° C. or higher and preferably 60° C. or higher, and for example, 140° C. or lower and preferably 130° C. or lower.

Such discotic liquid crystalline compounds may be used alone, or can also be used in combination of two or more types.

Among such discotic liquid crystalline compounds, a cyclic dimer, where in General Formula (4) above, n is 1, namely a cyclic dimer represented by Chemical Formula (11) below, and a cyclic trimer, where in General Formula (4) above, n is 2, namely a cyclic trimer represented by Chemical Formula (12) below are preferably cited, and the cyclic dimer represented by Chemical Formula (11) below is further preferably cited.

Chemical Formula (11):

(11)

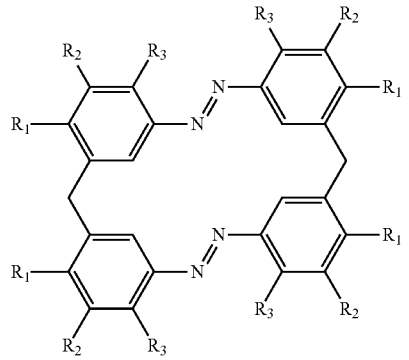

(In Formula (11), $R_1$, $R_2$, and $R_3$ represent the same functional groups as those of $R_1$, $R_2$, and $R_3$ in General Formula (4) above respectively.)

Chemical Formula (12):

(12)

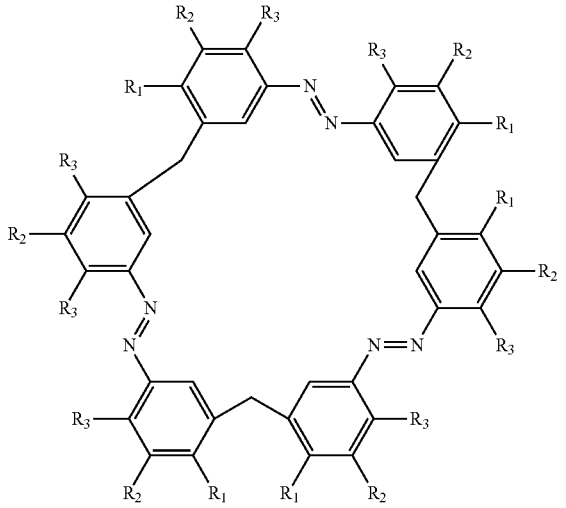

(In Formula (12), $R_1$, $R_2$, and $R_3$ represent the same functional groups as those of $R_1$, $R_2$, and $R_3$ in General Formula (4) above respectively.)

In order to prepare the discotic liquid crystalline compound represented by General Formula (4) above, for example, a methylene-bridged dimerized nitrobenzene derivative represented by General Formula (13) below as a second intermediate is reductively cyclized with a well-known reducing agent such as lithium aluminum hydride.

General Formula (13):

(13)

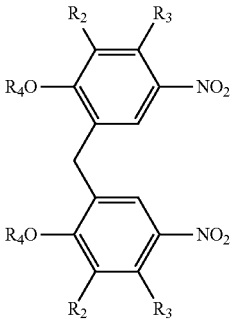

(In Formula (13), $R_2$ and $R_3$ represent the same substituents as those of $R_2$ and $R_3$ in General Formula (4) above, and $R_4$ represents an alkyl group.)

Further, the methylene-bridged dimerized nitrobenzene derivative represented by General Formula (13) above, which will be described in detail in Preparation examples, is prepared in a manner that as represented by General Formula (14) below, a nitrobenzene derivative is dimerized with formaldehyde to prepare a first intermediate, and then as represented by General Formula (15) below, the first intermediate and an alkyl halide are made to react with each other to introduce a substituent into the first intermediate.

General Formula (14):

(14)

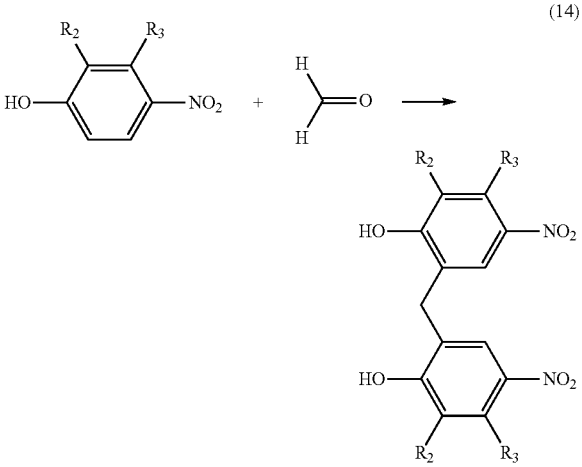

First Intermediate (In Formula (14), $R_2$ and $R_3$ represent the same substituents as those of $R_2$ and $R_3$ in General Formula (4) above.)

General Formula (15):

(15)

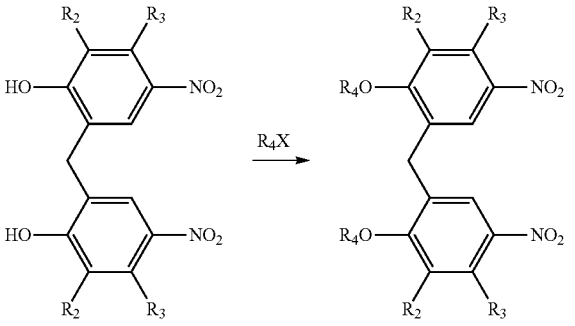

First Intermediate Second Intermediate (In Formula (15), $R_2$ and $R_3$ represent the same substituents as those of $R_2$ and $R_3$ in General Formula (4) above, and $R_4$ represents the same alkyl group as that of $R_4$ in General Formula (13) above.)

As the alkyl halide represented as $R_4X$ in General Formula (15) above, for example, an alkyl halide having a number of carbon or carbons of 1 to 20 is cited, and preferably an alkyl halide having a number of carbons of 8 to 16 is cited. Further, as the alkyl halide, for example, fluorine, chlorine, bromine, iodine, and the like are cited, and the bromine is preferably cited. That is, as the alkyl halide, an alkyl bromide having a number of carbons of 8 to 16 is preferably cited, and bromododecanoic acid is further preferably cited.

(1-1-3) Organic Solvent

The organic solvent is not limited in particular as long as it can dissolve or swell the UV softening material, and the same ones as the above-described organic solvents are cited, for example. Such organic solvents can be used alone, or can also be used in combination of two or more types. Further, among such organic solvents, ketones and halogenated hydrocarbons are preferably cited, and methyl ethyl ketone and dichloromethane are further preferably cited.

(1-1-4) Aqueous Medium

As the aqueous medium, a water, and aqueous media having water as a main component and mixing a slight amount/slight amounts of water-soluble solvent/water-soluble solvents such as, for example, alcohols or/and glycols therewith, or mixing an arbitrary component/arbitrary components of, for example, a surfactant or/and a dispersing agent therewith are cited. As the aqueous medium, one obtained by mixing water and a surfactant is preferably used according to the following emulsification method.

As the surfactant, for example, a cationic surfactant, an anionic surfactant, a nonionic surfactant, and the like are cited. Examples of the cationic surfactant include: dodecylammonium chloride; dodecylammonium bromide; dodecyltrimethylammonium bromide; dodecylpyridinium chloride; dodecylpyridinium bromide; hexadecyltrimethylammonium bromide; and the like, for example. Further, examples of the anionic surfactant include: fatty acid soaps such as, for example, sodium stearate and sodium dodecanoate; dodecyl sodium sulfate; sodium dodecylbenzenesulfonate; sodium lauryl sulfate; and the like, for example. Further, examples of the nonionic surfactant include: polyoxyethylene dodecyl ether; polyoxyethylene hexadecyl ether; polyoxyethylene nonylphenyl ether; polyoxyethylene lauryl ether, polyoxyethylene sorbitan monooleate ether; monodecanoyl sucrose; and the like, for example.

Such surfactants can be used alone, or can also be used in combination of two or more types. Further, among such surfactants, the anionic surfactant is preferably cited, and the sodium dodecylbenzenesulfonate is further preferably cited.

The mixing ratio of the surfactant is, for example, 0.01 parts by mass or more and preferably 0.04 parts by mass or more, and for example, 10 parts by mass or less and preferably 1 part by mass or less relative to 100 parts by mass of water.

(1-1-5) Preparation of UV Softening Material Emulsified Liquid

In order to prepare the UV softening material suspension, the UV softening material emulsified liquid is first prepared.

The UV softening material emulsified liquid is prepared in a manner that for example, a UV softening material liquid in which the UV softening material is dissolved in or swollen with an organic solvent is first prepared, and then the UV softening material liquid is emulsified in an aqueous medium.

The method of mixing the UV softening material in the organic solvent is not limited in particular, and for example, the UV softening material is mixed in the organic solvent to be agitated and mixed so that the UV softening material is dissolved or swollen. Thereby, the UV softening material liquid is prepared.

Further, the mixing ratio of the UV softening material is, for example, 5 parts by mass or more and preferably 10 parts by mass or more, and for example, 100 parts by mass or less and preferably 50 parts by mass or less relative to 100 parts by mass of the organic solvent.

Next, the UV softening material liquid is mixed with the aqueous medium to then be agitated using a well-known dispersing machine such as a homogenizer. Thereby, the UV softening material liquid turns into liquid droplets to be emulsified in the aqueous medium, to then be prepared to the UV softening material emulsified liquid.

The mixing ratio of the UV softening material liquid is, for example, 10 parts by mass or more and preferably 30 parts by mass or more, and for example, 150 parts by mass or less and preferably 120 parts by mass or less relative to 100 parts by mass of the aqueous medium.

Further, each temperature of the UV softening material liquid and the aqueous medium when the UV softening material liquid and the aqueous medium are mixed falls within a temperature range of lower than the boiling point of the organic solvent, and is, for example, 20° C. or higher and preferably 30° C. or higher, and for example, 80° C. or lower and preferably 75° C. or lower. The temperature of the UV softening material liquid and the temperature of the aqueous medium when the UV softening material liquid and the aqueous medium are mixed may be the same with each other or may also be different from each other, and are preferably the same with each other.

Further, as agitation conditions of the dispersing machine, in the case of the capacity being 1 L to 3 L or less, for example, a rotation speed of the dispersing machine is, for example, 5000 rpm or more and preferably 7000 rpm or more, and for example, 20000 rpm or less so that for example, a tip peripheral speed becomes 4 m/s or more and preferably 7 m/s or more and for example, 17 m/s or less and preferably 14 m/s or less, and an agitation time of the dispersing machine is, for example, 5 minutes or longer and preferably 10 minutes or longer, and for example, 60 minutes or shorter and preferably 50 minutes or shorter.

Incidentally, in the preparation of the UV softening material emulsified liquid, the UV softening material liquid may be mixed in the aqueous medium, or the aqueous medium can also be mixed in the UV softening material liquid. When the aqueous medium is mixed in the UV softening material liquid, a phase inversion emulsification method can also be used.

(1-1-6) Preparation of UV Softening Material Suspension

Then, the UV softening material suspension is prepared by removing the organic solvent from the UV softening material emulsified liquid.

As a method of removing the organic solvent from the UV softening material emulsified liquid, well-know methods, which are, for example, ventilation, heating, decompression, combination of these, and the like, are cited.

Specifically, the UV softening material emulsified liquid is heated at, for example, ordinary temperature and preferably at 30° C. or higher, and at, for example, 90° C. or lower and preferably at 80° C. or lower under an atmosphere of inert gas, which is nitrogen or the like, for example until about not less than 80 mass % nor more than 95 mass % of the initial organic solvent amount is removed, and thereby the organic solvent is removed. Thereby, the organic solvent is removed from the aqueous medium, and the UV softening material suspension, in which UV softening material microparticles are dispersed in the aqueous medium, is prepared.

The volume average particle diameter of UV softening material microparticles in the UV softening material suspension is, for example, 50 nm or more and preferably 90 nm or more, and for example, 1500 nm or less and preferably 1200 nm or less as a median diameter.

The volume average particle diameter of the UV softening material microparticles can be set to be within the above-described range by appropriately controlling a viscosity at which the UV softening material is mixed in the organic solvent, a mixing ratio of the UV softening material liquid and water, an agitation speed of a high-speed dispersing machine at which the UV softening material emulsified liquid is prepared, and the like.

(1-1-7) Preparation of Charge Control Agent Suspension

The charge control agent suspension, namely a charge control agent suspension in which microparticles of a charge control agent are dispersed is prepared in a manner that for example, from a charge control agent emulsified liquid obtained by mixing a charge control agent, an organic solvent, and an aqueous medium and emulsifying the mixed resultant, the organic solvent is removed.

(1-1-8) Charge Control Agent

The charge control agent is used alone or in combination, among negatively-charging charge control agents or positively-charging charge control agents, depending on an object and a purpose, and a well-known one can be used. For example, when the charge control agent is a charge control resin made of a synthetic resin, the charge control agent can be made to well adhere to later-described toner base particles. Further, when the charge control resin is a synthetic resin having a cationic group, it is possible to give positive chargeability to the toner stably.

Examples of the cationic group include: a quaternary ammonium group; a quaternary ammonium salt-containing group; an amino group; a phosphonium salt-containing group; and the like, for example. Among the cationic groups, the quaternary ammonium salt-containing group is preferably cited. When the cationic group is the quaternary ammonium salt-containing group, the charge control resin can be stably emulsified, and thereby it is possible to improve charging stability of the obtained toner.

Further, examples of the synthetic resin include: an acrylic resin; an acryl-styrene resin; a polystyrene resin; a polyester resin; and the like, for example. Among the synthetic resins, the acrylic resin and the acryl-styrene resin are preferably cited, and the acryl-styrene resin is further preferably cited. As long as the synthetic resin is the acryl-styrene resin, when the binder resin of the later-described toner base particle is a polyester resin, the acryl-styrene resin does not easily phase-dissolve with the binder resin, and therefore phase-dissolution of the charge control resin in the toner base particle can be suppressed, resulting in that it is possible to give stable chargeability to the toner. Such synthetic resins can be used alone or can also be used in combination of two or more types.

Further, the charge control resin containing the quaternary ammonium salt-containing group can be produced according to the descriptions of Japanese Patent Application Laid-open No. 63-60458, Japanese Patent Application Laid-open No. H03-175456, Japanese Patent Application Laid-open No. H03-243954, Japanese Patent Application Laid-open No. H11-15192, and the like. Further, examples of the charge control resin containing the quaternary ammonium salt-containing group include FCA-207P, FCA-161P, FCA-78P, FCA-201PS, and the like, for example, which are sold by Fujikura Kasei Co., Ltd, for example.

Further, a glass transition point Tg of the charge control resin is, for example, 40° C. or higher and preferably 55° C. or higher, and for example, 100° C. or lower and preferably 80° C. or lower from the viewpoint of storage stability and thermal fixation of the toner.

(1-1-9) Organic Solvent

As the organic solvent, for example, the same ones as the above-described organic solvents are cited, and ketones are preferably cited, and methyl ethyl ketone is further preferably cited. Such organic solvents may be used alone, or can also be used in combination of two or more types.

(1-1-10) Aqueous Medium

As the aqueous medium, the same ones as the above-described aqueous media are cited, and water is preferably cited.

(1-1-11) Preparation of Charge Control Agent Emulsified Liquid

In order to prepare the charge control agent suspension, a charge control agent emulsified liquid is first prepared.

The charge control agent emulsified liquid is prepared in a manner that for example, a charge control agent liquid in which the charge control agent is dissolved in or swollen with an organic solvent is first prepared, and then the charge control agent liquid is emulsified in an aqueous medium.

The method of mixing the charge control agent in the organic solvent is not limited in particular, and for example, the charge control agent is mixed in the organic solvent to be agitated and mixed so that the charge control agent is dissolved therein or swollen therewith. Thereby, the charge control agent liquid is prepared.

Further, the mixing ratio of the charge control agent is, for example, 5 parts by mass or more and preferably 10 parts by mass or more, and for example, 100 parts by mass or less and preferably 50 parts by mass or less relative to 100 parts by mass of the organic solvent.

Next, the charge control agent liquid is mixed with the aqueous medium, to then be agitated using a well-known dispersing machine such as a homogenizer. Thereby, the charge control agent liquid turns into liquid droplets to be emulsified in the aqueous medium, and thereby the charge control agent emulsified liquid is prepared.

The mixing ratio of the charge control agent liquid is, for example, 50 parts by mass or more and preferably 80 parts by mass or more, and for example, 200 parts by mass or less and preferably 150 parts by mass or less relative to 100 parts by mass of the aqueous medium. Further, agitation conditions of the dispersing machine are the same as those described above, for example.

Incidentally, the charge control agent emulsified liquid can also be prepared in a manner that an aqueous medium and an organic solvent are first mixed and then the charge control agent is mixed in the obtained mixture of the aqueous medium and the organic solvent to be agitated in the same manner as above.

Further, the charge control agent emulsified liquid can be prepared using a polar group of the charge control agent without mixing an emulsion stabilizer such as a surfactant, a dispersing agent, or a neutralizing agent, for example, therewith. Therefore, it is possible to decrease the emulsion stabilizer to be contained in the obtained toner and stabilize the chargeability of the toner.

(1-1-12) Preparation of Charge Control Agent Suspension

Then, the charge control agent suspension is prepared by removing the organic solvent from the charge control agent emulsified liquid.

Incidentally, since the charge control agent has a polar group, in the preparation of the charge control agent emulsified liquid, the charge control agent dissolved in or swollen with the organic solvent is stably emulsified in the aqueous medium. Then, since the charge control agent suspension is obtained by removing the organic solvent from this charge control agent emulsified liquid, the charge control agent suspension is prepared as a suspension of charge control agent microparticles with few aggregates.

As a method of removing the organic solvent from the charge control agent emulsified liquid, the same method as that of removing the organic solvent from the UV softening material emulsified liquid described above is cited. Thereby, the organic solvent is removed from the aqueous medium, and the charge control agent suspension, in which the charge control agent microparticles are dispersed in the aqueous medium, is prepared.

The volume average particle diameter of the charge control agent microparticles is, for example, 50 nm or more and preferably 90 nm or more, and for example, 600 nm or less as the median diameter.

The volume average particle diameter of the charge control agent microparticles can be set to be within the above-described range by appropriately controlling a viscosity at which the charge control agent is mixed in the organic solvent, a mixing ratio of the charge control agent liquid and water, an agitation speed of a high-speed dispersing machine at which the charge control agent emulsified liquid is prepared, and the like.

(1-2) Toner Base Particle Preparation Step

Further, in the toner base particle preparation step, separately from the additive preparation step, a base microparticle suspension containing a binder resin and a colorant is prepared and the base microparticle suspension is heated, to thereby aggregate base microparticles, and a toner base particle suspension in which toner base particles are dispersed is prepared.

(1-2-1) Base Microparticle Suspension

The base microparticle suspension, namely a base microparticle suspension in which base microparticles are dispersed is prepared in a manner that from a binder resin emulsified liquid obtained by mixing a binder resin, a colorant, an organic solvent, and an aqueous medium and emulsifying the mixed resultant, the organic solvent is removed.

(1-2-2) Binder Resin

The binder resin is a main component of the toner, and for example, a polyester resin having a functional group having an acid value such as a carboxyl group is cited. By using the binder resin together with the UV softening resin, the binder resin works also to maintain strength of the toner particles during image formation.

Examples of the polyester resin having an acid value include polyester resins whose acid values are, for example, 0.5 mgKOH/g or more and preferably 1.0 mgKOH/g or more and for example, 40 mgKOH/g or less and preferably 20 mgKOH/g or less and whose weight-average molecular weights by GPC measurement with standard polystyrene set as a calibration curve are, for example, 9,000 or more and preferably 20,000 or more and for example, 200,000 or less and preferably 150,000 or less and that have an undissolved tetrahydrofuran content, namely a gel content, being, for example, 10 mass % or less and for example, 0.5 mass % or more and whose glass transition points Tg are, for example, 50° C. or higher and preferably 55° C. or higher and for example, 70° C. or lower and preferably 65° C. or lower. Specifically, examples of the polyester resin include, for example, FC1565, FC023, FC1494, FC1233, ER508, ER502, and the like, which are sold by MITSUBISHI RAYON CO., LTD., for example.

When the acid value is lower than the above-described lower limit value, an amount to react with a base such as a sodium hydroxide to be added later is small, and therefore there is sometimes a case that emulsification becomes unstable to make it impossible to obtain a stable slurry. When the acid value is higher than the above-described upper limit value, on the other hand, there is sometimes a case that positive chargeability of the toner decreases to cause a decrease in image density, and the like.

Further, when the weight-average molecular weight is lower than the above-described lower limit value, there is sometimes a case that mechanical strength of the toner becomes insufficient and durability of the toner decreases. When the weight-average molecular weight is higher than the above-described upper limit value, on the other hand, there is sometimes a case that melt viscosity of the toner increases excessively, emulsified liquid droplets become large, and coarse particles are likely to be generated.

Further, the gel content does not have to exist at all, but that the gel content exists to some existent is suitable for strength and fixation of the toner, particularly for the strength of the toner. However, when it is larger than the above-described upper limit value, there is sometimes a case that emulsified liquid droplets become large and coarse particles are generated.

(1-2-3) Colorant

The colorant is one for imparting a desired color to the toner, and is dispersed or penetrated in the binder resin.

Examples of the colorant include: for example, carbon black; organic pigments such as, for example, Quinophthalone Yellow, Hansa Yellow, Isoindolinone Yellow, Benzidine Yellow, Perinone Orange, Perinone Red, Perylene Maroon, Rhodamine 6G Lake, Quinacridone Red, Rose Bengal, Copper Phthalocyanine Blue, Copper Phthalocyanine Green, and a diketopyrrolopyrrole-based pigment; inorganic pigments and metal powders such as, for example, Titanium White, Titanium Yellow, ultramarine blue, Cobalt Blue, red iron oxide, aluminum powder, and bronze; oil-soluble dyes and dispersion dyes such as, for example, azo-based dyes, quinophthalone-based dyes, anthraquinone-based dyes, xanthene-based dyes, triphenylmethane-based dyes, phthalocyanine-based dyes, indophenol-based dyes, and indoaniline-based dyes; rosin-based dyes such as, for example, rosin, rosin-modified phenol, and a rosin-modified maleic acid resin; and further dyes and pigments treated with higher fatty acid, resin, and/or the like; and the like.

Such colorants can be used alone, or can also be used in combination of two or more types, according to a desired color. In the case of a mono-chromatic color toner, for example, a pigment and a dye of the same series of color, which are, for example, rhodamine-based pigment and dye, quinophthalone-based pigment and dye, or phthalocyanine-based pigment and dye, are mixed.

The colorant is mixed at a ratio of, for example, 2 parts by mass or more and preferably 4 parts by mass or more and for example, 40 parts by mass or less, preferably 30 parts by mass or less, and further preferably 10 parts by mass or less relative to 100 parts by mass of the binder resin.

(1-2-4) Organic Solvent

As the organic solvent in the toner base particle preparation step, for example, the same ones as the above-described organic solvents are cited, and ketones are preferably cited, and methyl ethyl ketone is further preferably cited. Such organic solvents may be used alone, or can also be used in combination of two or more types.

(1-2-5) Aqueous Medium

As the aqueous medium in the toner base particle preparation step, for example, the same ones as the above-described aqueous media, and an alkaline aqueous solution are cited.

As the alkaline aqueous solution, there are cited for example, an organic base aqueous solution obtained by dissolving a basic organic compound such as amines in water, and for example, an inorganic base aqueous solution obtained by dissolving an alkali metal hydroxide such as sodium hydroxide or potassium hydroxide, and/or the like in water.

Among such aqueous media, the alkaline aqueous solution is preferably cited, and the inorganic base aqueous solution is further preferably cited.

The inorganic base aqueous solution is prepared as an aqueous sodium hydroxide solution or an aqueous potassium hydroxide solution, which is, for example, 0.1 normal or more and preferably 0.2 normal or more and for example, 5 normal or less and preferably 2 normal or less.

In order to prepare the aqueous medium in the toner base particle preparation step, the inorganic base aqueous solution is mixed at a mixing ratio of, for example, 0.1 parts by mass or more and preferably 1 part by mass or more and for example, 40 parts by mass or less and preferably 20 parts by mass or less relative to 100 parts by mass of water.

(1-2-6) Preparation of Binder Resin Emulsified Liquid

In order to prepare the base microparticle suspension, the binder resin emulsified liquid is first prepared.

The binder resin emulsified liquid is prepared in a manner that for example, a binder resin liquid obtained by mixing the binder resin and the colorant in the organic solvent is first prepared, and then the binder resin liquid is emulsified in an aqueous medium.

(1-2-7) Binder Resin Liquid

More specifically, the binder resin liquid is prepared in a manner that the binder resin and the colorant are mixed in the organic solvent, to then be agitated using a well-known dispersing machine such as a homogenizer.

The mixing ratio of the binder resin is, for example, 5 parts by mass or more and preferably 10 parts by mass or more, and for example, 100 parts by mass or less and preferably 50 parts by mass or less relative to 100 parts by mass of the organic solvent. Further, the mixing ratio of the colorant is, for example, 0.25 parts by mass or more and preferably 0.5 parts by mass or more, and for example, 10 parts by mass or less, preferably 8 parts by mass or less, and further preferably 3 parts by mass or less relative to 100 parts by mass of the organic solvent.

As the dispersing machine, there are cited, for example, an agitator having turbine blades or propeller blades such as a three-one motor, for example, a high-speed dispersing machine such as a rotor/stator type homogenizer, for example, a dispersing machine such as a high-pressure homogenizer, and the like.

Incidentally, the binder resin liquid can also be prepared in a manner that a colorant is dispersed in an organic solvent beforehand to prepare a colorant dispersion liquid, and this colorant dispersion liquid is mixed in an organic solvent.

In this case, the binder resin is preferably added to the colorant dispersion liquid in order to disperse the colorant in the organic solvent. The mixing ratio of the binder resin is, for example, 50 parts by mass or more and preferably 80 parts by mass or more, and for example, 200 parts by mass or less and preferably 150 parts by mass or less relative to 100 parts by mass of the colorant. Further, the mixing ratio of the organic solvent is, for example, 100 parts by mass or more and preferably 400 parts by mass or more, and for example, 3600 parts by mass or less and preferably 3500 parts by mass or less relative to 100 parts by mass of the colorant. Then, the colorant in the colorant dispersion liquid is preliminarily dispersed by an agitator such as a disper or a homogenizer, and next is finely dispersed by a dispersing machine such as a bead mill or a high-pressure homogenizer.

(1-2-8) Binder Resin Emulsified Liquid

Next, the binder resin liquid is mixed with the aqueous medium, to then be agitated using the same dispersing machine as that described above. Thereby, the binder resin liquid turns into liquid droplets that are not less than 100 nm nor more than 1000 nm to be emulsified in the aqueous medium, to then be prepared to the binder resin emulsified liquid.

The mixing ratio of the binder resin liquid is, for example, 50 parts by mass or more and preferably 80 parts by mass or more, and for example, 150 parts by mass or less and preferably 120 parts by mass or less relative to 100 parts by mass of the aqueous medium.

Further, each temperature of the binder resin liquid and the aqueous medium when the binder resin liquid and the aqueous medium are mixed falls within a temperature range of lower than the boiling point of the organic solvent, and is, for example, 30° C. or higher and preferably 40° C. or higher, and for example, 80° C. or lower and preferably 75° C. or lower. The temperature of the binder resin liquid and the temperature of the aqueous medium when the binder resin liquid and the aqueous medium are mixed may be the same with each other or may also be different from each other, and are preferably the same with each other.

Further, agitation conditions of the dispersing machine are that a tip peripheral speed thereof is, for example, 5 m/s or more and preferably 7 m/s or more, and for example, 20 m/s or less and preferably 14 m/s or less, and an agitation time thereof is, for example, 10 minutes or longer and preferably 15 minutes or longer, and for example, 120 minutes or shorter and preferably 60 minutes or shorter.

Incidentally, in the preparation of the binder resin emulsified liquid, the binder resin liquid may be mixed in the aqueous medium, or the aqueous medium can also be mixed in the binder resin liquid. When the aqueous medium is mixed in the binder resin liquid, a phase inversion emulsification method can also be used. In the phase inversion emulsification method normally, the aqueous medium is added to the binder resin liquid by a small amount at a time, so that a considerable time is required for emulsification, but according to such a preparation method, it is possible to increase the speed at which the aqueous medium is added and to improve productivity. Further, it is possible that an alkaline aqueous solution is mixed in the binder resin liquid beforehand to neutralize the binder resin liquid and then water is added to the neutralized resultant, or further water can also be added to the binder resin liquid that is neutralized beforehand.

(1-2-9) Base Microparticle Suspension

Then, the base microparticle suspension is prepared by removing the organic solvent from the binder resin emulsified liquid.

As a method of removing the organic solvent from the binder resin emulsified liquid, the same method as that of removing the organic solvent from the UV softening material emulsified liquid described above is cited.

Incidentally, it is also possible to prepare the later-described toner base particle suspension without volatilizing the organic solvent in this step. In this case, the base microparticles are aggregated and fused, and liquid droplets are formed to have sizes of the later-described toner base particles, and then the solvent is removed by a method of ventilation, heating, decompression, or the like.

The concentration of the base microparticles in the obtained base microparticle suspension, namely the solid content concentration in the base microparticle suspension is, for example, 5 mass % or more and preferably 10 mass % or more, and for example, 50 mass % or less and preferably 30 mass % or less. Further, the volume average particle diameter of the base microparticles in the base microparticle suspension is, for example, 30 nm or more and preferably 50 nm or more, and for example, 1000 nm or less and preferably 500 nm or less as the median diameter.

(1-2-10) Preparation of Toner Base Particle Suspension

The toner base particle suspension is prepared in a manner that for example, the base microparticle suspension is diluted, and then an aggregating agent is added thereto to aggregate the base microparticles, and the aggregated base microparticles are fused by heating.

In the preparation of the toner base particle suspension, the base microparticle suspension is diluted with an aqueous medium so that the solid content concentration becomes, for example, 1 mass % or more and preferably 5 mass % or more, and for example, 30 mass % or less and preferably 20 mass % or less.

Incidentally, when the base microparticle suspension is diluted, a surfactant can be added together with the aqueous medium as necessary. Incidentally, when the surfactant is added to the base microparticle suspension, it is also possible that a surfactant aqueous solution is prepared beforehand and the surfactant aqueous solution is added to the base microparticle suspension.

Examples of the surfactant include: polyoxyethylene polyoxypropylene glycol such as a polyoxyethylene polyoxypropylene block copolymer; polyoxyalkylene decyl ether; polyoxyalkylene tridecyl ether; polyoxyethylene isodecyl ether; polyoxyalkylene lauryl ether; polyoxyethylene alkyl ether; and the like, for example. Such surfactants may be used alone, or can also be used in combination of two or more types. Further, among such surfactants, the polyoxyethylene polyoxypropylene glycol is preferably cited, and the polyoxyethylene polyoxypropylene block copolymer is further preferably cited.

When the surfactant is added to the base microparticle suspension, the surfactant is mixed at a mixing ratio of, for example, 0.5 parts by mass or more and preferably 1 part by mass or more and for example, 20 parts by mass or less and preferably 10 parts by mass or less relative to 100 parts by mass of the solid content of the base microparticle suspension.

Next, the aggregating agent is added to the base microparticle suspension. Thereby, the base microparticles in the base microparticle suspension aggregate.

Examples of the aggregating agent include: inorganic metal salts such as, for example, aluminum chloride, magnesium chloride, and calcium nitrate; polymers of inorganic metal salts such as, for example, polyaluminum chloride; and the like. Such aggregating agents may be used alone, or can also be used in combination of two or more types. Further, among such aggregating agents, the inorganic metal salts are preferably cited, and the aluminum chloride is further preferably cited.

Such an aggregating agent is prepared to an aqueous solution, which is, for example, not less than 0.01 normal nor more than 0.05 normal preferably, and for example, 1.0 normal or less and preferably 0.5 normal or less. Then, the aggregating agent aqueous solution is added at a ratio of, for example, 0.1 parts by mass or more and preferably 0.5 parts by mass or more, and for example, 10 parts by mass or less and preferably 5 parts by mass or less relative to 100 parts by mass of the diluted base microparticle suspension to be agitated.

In order to agitate the base microparticle suspension to which the aggregating agent has been added, for example, the aggregating agent is first dispersed in the base microparticle suspension by a high-speed dispersing machine such as a homogenizer, and next the base microparticle suspension to which the aggregating agent has been added is agitated by an agitator. As the agitator, for example, an agitator equipped with an agitating blade such as a flat plate turbine blade, a propeller blade, or an anchor blade is cited. Further, the base microparticle suspension can also be agitated by an ultrasonic dispersing machine in place of the agitator.

Thereafter, an aggregation stopping agent is added to the base microparticle suspension. Thereby, the aggregation of the base microparticles is stopped.

As the aggregation stopping agent, for example, alkali metal hydroxides such as sodium hydroxide and potassium hydroxide are cited. Further, as the aggregation stopping agent, an ionic surfactant can also be used.

Such an aggregation stopping agent is prepared as an aqueous solution, which is, for example, 0.01 normal or more and preferably 0.1 normal or more, and for example, 5.0 normal or less and preferably 2.0 normal or less. Then, the aggregation stopping agent aqueous solution is added to the base microparticle suspension at a ratio of, for example, 0.5 parts by mass or more and preferably 1.0 part by mass or more, and for example, 20 parts by mass or less and preferably 10 parts by mass or less relative to 100 parts by mass of the base microparticle suspension, and agitation is continued.

Incidentally, when the aggregation stopping agent is added, a surfactant such as polyoxyalkylene branched decyl ether, for example, can also be added as an auxiliary additive.

Next, the base microparticle suspension is heated. Thereby, the aggregated base microparticles are fused. More specifically, while being agitated, the base microparticle suspension is heated at a temperature equal to or higher than the glass transition point of the base microparticle until the base microparticles are fused to a desired shape. The heating temperature at this time is, for example, 55° C. or higher and preferably 65° C. or higher, and for example, 100° C. or lower. Further, a heating time is, for example, 0.5 hours or longer, and for example, 10 hours or shorter, which varies depending on the type of binder resin. When the heating time is short, it is possible to obtain toner base particles having irregular shapes, which are not spherical, in other words, and when the heating time is long, it is possible to obtain toner base particles having a spherical shape. In this manner, the aggregated base microparticles are fused to form the toner base particles. Thereby, the toner base particle suspension in which the toner base particles are dispersed is prepared.

A volume-based average particle diameter Dv of the toner base particles is, for example, 3 μm or more and preferably 6 μm or more, and for example, 12 μm or less and preferably 10 μm or less. Incidentally, the volume-based average particle diameter DV is measured by a method described in Preparation examples to be described later.

(1-3) Toner Preparation Step (1-3-1) Preparation of Mixture of Charge Control Agent Suspension and Toner Base Particle Suspension In the toner preparation step, the charge control agent suspension and the toner base particle suspension are first mixed with each other, and thereby a first mixture is prepared.

The mixing of the charge control agent suspension and the toner base particle suspension is not limited in particular, and for example, the charge control agent suspension and the toner base particle suspension are mixed with each other to be agitated appropriately.

The charge control agent suspension is mixed with the base particle suspension so that a solid content of the charge control agent suspension, namely the charge control agent microparticles become for example, 0.2 parts by mass or more and for example, 10 parts by mass or less and preferably 5 parts by mass or less relative to 100 parts by mass of a solid content of the toner base particle suspension, namely the toner base particles.

When the ratio of the charge control agent microparticles in the first mixture is lower than the above-described ratio, there is sometimes a case that sufficient chargeability cannot be obtained because the amount of the charge control agent on the surfaces of the toner base particles becomes insufficient. On the other hand, when the ratio of the charge control agent microparticles in the first mixture is higher than the above-described ratio, there is sometimes a case that charge-up and the like are caused to deteriorate charging uniformity of the toner, resulting in that charging stability of the toner sometimes decreases. When the ratio of the charge control agent microparticles in the first mixture is the above-described ratio, it is possible to further stabilize the chargeability of the toner.

The charge control agent suspension and the toner base particle suspension are mixed with each other by agitating the mixture to such an extent that the whole mixture flows by an agitator such as a three-one motor, for example. As an agitating blade, a well-known one can be used, and for example, a flat plate turbine blade, a propeller blade, an anchor blade, or the like can be used.

Thereby, the charge control agent microparticles are electrostatically attached to the toner base particles in the first mixture.

(1-3-2) Preparation of Mixture of First Mixture and UV Softening Material Suspension Next, the first mixture is heated, and then the UV softening material suspension is added to the first mixture. Thereby, the first mixture and the UV softening material suspension are mixed with each other, and a second mixture is prepared.

A heating temperature of the first mixture at the mixing is, for example, 40° C. or higher and preferably 50° C. or higher, and for example, 70° C. or lower and preferably 65° C. or lower.

Further, the UV softening material suspension is mixed with the first mixture so that a solid content of the UV softening material suspension, namely the UV softening material microparticles, becomes, for example, 0.2 parts by mass or more and for example, 10 parts by mass or less and preferably 8 parts by mass or less relative to 100 parts by mass of the toner base particles in the first mixture.

When the ratio of the UV softening material microparticles in the second mixture is lower than the above-described ratio, there is sometimes a case that sufficient fixation to a transfer medium cannot be obtained because the amount of the UV softening material on the surfaces of the toner base particles becomes insufficient. When the ratio of the UV softening material microparticles in the second mixture is the above-described ratio, it is possible to further stabilize the toner fixation to a transfer medium.

(1-3-3) Preparation of Toner Particles

Next, the second mixture is agitated to such an extent that the whole mixture flows by an agitator such as a three-one motor, for example. As an agitating blade, a well-known one can be used, and for example, a flat plate turbine blade, a propeller blade, an anchor blade, or the like can be used.

Agitation conditions are that the temperature is, for example, 40° C. or higher and preferably 50° C. or higher and for example, 70° C. or lower and preferably 65° C. or lower, and the time is, for example, 3 minutes or longer and preferably 10 minutes or longer and for example, 40 minutes or shorter and preferably 20 minutes or shorter.

Thereby, the UV softening material microparticles and the charge control agent microparticles adhere and are fused to the surfaces of the toner base particles, and toner particles are formed. Then, the toner particles are filtered, and then are washed with distilled water as necessary to be dried.

In such toner particles, the coverage of the UV softening material microparticle to the surface area of the toner base particle is, for example, 2% or more, preferably 7% or more, and further preferably 13% or more, and for example, 100% or less and preferably 79% or less. Incidentally, the coverage of the UV softening material microparticle to the surface area of the toner base particle is measured by a method described in Preparation examples to be described later.

When the above-described coverage is lower than the above-described percentage, there is sometimes a case that sufficient fixation to a transfer medium cannot be obtained because the amount of the UV softening material on the surfaces of the toner base particles becomes insufficient. When the above-described coverage is the above-described percentage, it is possible to further stabilize the toner fixation to a transfer medium.

(1-4) External Additive

Thereafter, an external additive is added as necessary. The external additive is added in order to adjust the chargeability, fluidity, storage stability, and the like of the toner, and is composed of ultramicroparticles having a particle diameter extremely smaller than that of the toner base particles. As the external additive, for example, inorganic particles and synthetic resin particles are cited.

Examples of the inorganic particles include: silica; aluminum oxide; titanium oxide; silicon aluminum cooxide; silicon titanium cooxide; and hydrophobicized products of these; and the like, for example. For example, a hydrophobicized product of silica can be obtained by treating silica micropowder with silicone oil or/and a silane coupling agent. Examples of the silane coupling agent include: dichlorodimethylsilane; hexamethyldisilazane; tetramethyldisilazane; and the like, for example.

Examples of the synthetic resin particles include: methacrylate ester polymer particles; acrylate ester polymer particles; styrene-methacrylate ester copolymer particles; styrene-acrylate ester copolymer particles; core-shell type particles with a core thereof composed of a styrene polymer and a shell thereof composed of a methacrylate polymer, and the like, for example.

The addition of the external additive is not limited in particular, and the toner particles obtained by the above and the external additive are agitated and mixed using a high-speed agitator such as a Henschel mixer, for example. The addition amount of the external additive is not limited in particular, but is 0.1 to 6 parts by mass normally relative to 100 parts by mass of the toner particles obtained by the above.

(2) Second Toner

As for the first toner, the UV softening material adheres to the surfaces of the toner base particles containing the binder resin and the colorant, but as for a second toner, the UV softening material is contained in the toner base particles as the binder resin. Such a second toner is produced by undergoing the additive preparation step, the toner base particle preparation step, and the toner preparation step, for example. Incidentally, in the preparation of the second toner, explanations of the parts common to the preparation of the first toner are omitted and only the parts different from the preparation of the first toner are explained.

(2-1) Additive Preparation Step

As for the second toner, an additive is an arbitrary component, but a charge control agent is preferably contained as an additive.

When the charge control agent is contained in the toner, a charge control agent suspension is prepared in the additive preparation step. Such a charge control agent suspension is prepared in the same manner as the preparation of the charge control agent suspension in the preparation of the first toner described above.

(2-2) Toner Base Particle Preparation Step (2-2-1) Preparation of Base Microparticle Suspension A base microparticle suspension in which base microparticles are dispersed is prepared in a manner that from a binder resin emulsified liquid obtained by mixing a binder resin, a colorant, an organic solvent, and an aqueous medium and emulsifying the mixed resultant, the organic solvent is removed.

The binder resin is a main component of the toner, and contains at least the above-described UV softening material and contains, as necessary, a well-known resin/well-known resins such as the polyester resin described in the preparation of the first toner above. Such a binder resin may be a mixture of the UV softening material and a well-known resin/well-known resins such as the polyester resin, but is preferably composed of only the above-described UV softening material.

As the organic solvent, for example, the organic solvents described in the preparation of the first toner above are cited. Among such organic solvents, ketones and halogenated hydrocarbons are preferably cited, and methyl ethyl ketone and dichloromethane are further preferably cited.

(2-2-2) Preparation of Binder Resin Emulsified Liquid

The binder resin emulsified liquid is prepared in a manner that for example, a binder resin liquid obtained by mixing the binder resin and the colorant in the organic solvent is first prepared, and then the binder resin liquid is emulsified in the aqueous medium. The binder resin liquid is prepared in a manner that the binder resin and the colorant are mixed in the organic solvent, to then be agitated using a well-known dispersing machine such as a homogenizer.

Incidentally, the binder resin liquid can also be prepared in a manner that a colorant is dispersed in an organic solvent beforehand to prepare a colorant dispersion liquid, and this colorant dispersion liquid is mixed in an organic solvent, similarly to the above-described first embodiment. In this case, as the organic solvent to be used, the same organic solvent as that of the first embodiment is cited.

Next, the binder resin liquid is mixed with the aqueous medium, to then be agitated using the same dispersing machine as described above. Thereby, the binder resin liquid turns into liquid droplets, which are not less than 100 nm nor more than 1000 nm, to be emulsified in the aqueous medium, to then be prepared to the binder resin emulsified liquid.

In the preparation step of the binder resin emulsified liquid, the mixing ratio of the binder resin liquid is, for example, 10 parts by mass or more and preferably 15 parts by mass or more, and for example, 100 parts by mass or less and preferably 50 parts by mass or less relative to 100 parts by mass of the aqueous medium.

Further, in the preparation step of the binder resin emulsified liquid, a dispersion stabilizer can be added together with the aqueous medium as necessary.

Examples of the dispersion stabilizer include: inorganic compounds such as, for example, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic compounds such as, for example, polyvinyl alcohol, gelatin, methylcellulose, methyl hydroxypropyl cellulose, ethyl cellulose, carboxymethyl cellulose sodium salt, polyacrylic acid and its salt, starch, polyacrylamide, polyethylene oxide, and poly(hydroxystearic acid-methyl methacrylate-methacrylic acid)copolymer.

Such dispersion stabilizers can be used alone, or can also be used in combination of two or more types. Further, among such dispersion stabilizers, the inorganic compounds are preferably cited, and the tricalcium phosphate is further preferably cited.

When the dispersion stabilizer is added to the binder resin emulsified liquid, the dispersion stabilizer is mixed at a mixing ratio of, for example, 1 part by mass or more and preferably 5 parts by mass or more and for example, 60 parts by mass or less and preferably 30 parts by mass or less relative to 100 parts by mass of the binder resin in the binder resin emulsified liquid.

Further, when the dispersion stabilizer is added to the binder resin emulsified liquid, it is also possible that a dispersion stabilizer aqueous solution is prepared beforehand and the dispersion stabilizer aqueous solution and the binder resin liquid are mixed with each other.

The dispersion stabilizer aqueous solution is adjusted so that a concentration thereof becomes, for example, 1 mass % or more and preferably 5 mass % or more and for example, 30 mass % or less and preferably 15 mass % or less, and the dispersion stabilizer aqueous solution is mixed at a ratio of, for example, 10 parts by mass or more and preferably 30 parts by mass or more and for example, 600 parts by mass or less and preferably 300 parts by mass or less relative to 100 parts by mass of the binder resin liquid.

(2-2-3) Preparation of Base Microparticle Suspension

Next, the base microparticle suspension is prepared by removing the organic solvent from the binder resin emulsified liquid by the same method as described above. Thereby, the base microparticles in the base microparticle suspension aggregate, and toner base particles are formed.

The volume-based average particle diameter Dv of the toner base particles is, for example 3 μm or more and preferably 6 μm or more, and for example, 12 μm or less and preferably 10 μm or less. Incidentally, the volume-based average particle diameter DV is measured by a method described in Preparation examples to be described later.

(2-3) Preparation of Toner Base Particle Suspension

Next, the toner base particles, when the dispersion stabilizer has been added, are filtered out and then are dispersed in an acid aqueous solution to be agitated. Thereby, the dispersion stabilizer on the surfaces of the toner base particles are dissolved to be removed.

As the acid aqueous solution, for example, a hydrochloric acid aqueous solution, a sulfuric acid aqueous solution, a nitric acid aqueous solution, and the like are cited, and the hydrochloric acid aqueous solution is preferably cited. Such an acid aqueous solution is adjusted so that its normality becomes, for example, 0.01 or more and preferably 0.03 or more, and for example, 0.2 or less and preferably 0.1 or less.

Next, after the toner base particles are filtered out, for example, they are washed with distilled water as necessary, and are dispersed in distilled water again. Thereby, the toner base particle suspension in which the toner base particles are dispersed is prepared.

The solid content concentration of the toner base particle suspension is, for example, 1 mass % or more and preferably 5 mass % or more, and for example, 30 mass % or less and preferably 20 mass % or less.

(2-4) Toner Preparation Step

In the toner preparation step, the charge control agent suspension and the toner base particle suspension are first mixed with each other, and thereby, a first mixture is prepared. Thereby, the charge control agent microparticles are electrostatically attached to the toner base particles in the first mixture.

Next, the first mixture is heated to, for example, 40 to 70° C. and preferably 50 to 65° C., to then be agitated for, for example, 3 to 40 minutes and preferably 10 to 20 minutes.

Thereby, the charge control agent microparticles adhere and are fused to the surfaces of the toner base particles, and toner particles are formed.

(3) Preparation Examples

Hereinafter, the first toner and the second toner are explained further in detail while citing concrete preparation examples. In the preparation examples, part/parts and % denoting the mixing ratio are based on mass. Further, numerical values such as the mixing ratio and the like in the preparation examples can be replaced with the upper limit values or the lower limit values of the corresponding parts described in the preparations of the first toner and the second toner described above.

(3-1) Preparation Example 1 to Preparation Example 11

(3-1-1) Additive Preparation Step (3-1-1-1) Preparation of UV Softening Material Suspension A (Synthesis of UV Softening Material A)

105 parts of 4-hexyl-4'-hydroxyazobenzene, 99 parts of 11-bromoundecanoic acid, and 46 parts of potassium hydroxide were dissolved in 2923 parts of ethanol, to obtain a raw material solution. Next, the raw material solution was agitated for 3 days at 100° C., to then be neutralized with hydrochloric acid and acetic acid. Thereby, precipitates precipitated in the raw material solution. Then, the precipitates in the raw material solution were filtered out, to then be washed with water.

Next, the obtained precipitates were separated by column chromatography with a mixed solvent of chloroform:ethyl acetate=9:1 being a developing solvent, to obtain 90 parts of 11-[4-(4-hexylphenylazo)phenoxy]undecanoic acid.

Next, 88 parts of the 11-[4-(4-hexylphenylazo)phenoxy] undecanoic acid was dissolved in 398 parts of dehydrated dichloromethane, to obtain an intermediate solution. Then, 164 parts of thionyl chloride was added to the intermediate solution, and then the intermediate solution was subjected to heating and reflux for 1 hour. Then, dichloromethane and thionyl chloride were distilled off from the intermediate solution obtained after the reflux, and then 663 parts of dehydrated dichloromethane was added to the resultant intermediate solution.

Next, the intermediate solution to which dichloromethane was added was slowly added to a mannitol suspension, in which 5 parts of D-mannitol were suspended in 295 parts of dehydrated pyridine, to then be agitated for 4 days at room temperature.

Next, an obtained reaction solution was refined by column chromatography with a mixed solvent of dichloromethane: hexane:ethyl acetate=25:25:1 being a developing solvent in the dark, and 26 parts of a UV softening material A represented by Chemical Formula (7) below (melting point 115° C.) was obtained.

Chemical Formula (7):

(7)

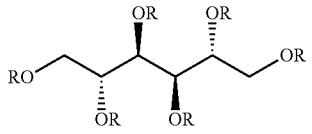

AzMn (in Formula (7), R represents a functional group represented by Chemical Formula (8) below.)

Chemical Formula (8):

(8)

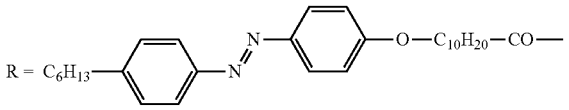

(Preparation of UV Softening Material Suspension A1)

80 parts of dichloromethane and 20 parts of the UV softening material A were mixed and agitated while being heated at 40° C., and a UV softening material liquid A in which the UV softening material A was dissolved was obtained.

Next, to 100 parts of the UV softening material liquid A, a mixture of 99.5 parts of distilled water warmed up to 40° C. and 0.5 parts of a 20% sodium dodecylbenzenesulfonate aqueous solution was added, and then the resultant UV softening material liquid A was agitated for 20 minutes at 16000 rpm by a homogenizer equipped with a shaft 18F to be emulsified, and a UV softening material emulsified liquid A was obtained. Incidentally, the 20% sodium dodecylbenzenesulfonate aqueous solution is a product with product name: NEOGENS-20A produced by DKS Co. Ltd. Further, the homogenizer is a product with product name: Silent Crusher M manufactured by Heidolph Instruments.

Then, the UV softening material emulsified liquid A was transferred into a separable flask, and heated and agitated at 40° C. for 90 minutes while blowing nitrogen into the gas phase, from which an organic solvent was removed, and a UV softening material suspension Al was obtained. The solid content concentration of the UV softening material suspension A1 was 11.5%. The volume average particle diameter of UV softening material microparticles in the UV softening material suspension A1, namely the median diameter D50 was 220 nm.

(3-1-1-2) Preparation of UV Softening Material Suspension A2

A UV softening material suspension A2 was prepared in the same manner as the preparation of the UV softening material suspension Al described above except that the distilled water was changed to 99.6 parts from 99.5 parts, the 20% sodium dodecylbenzenesulfonate aqueous solution was changed to 0.4 parts from 0.5 parts, and the rotation speed of the homogenizer was changed to 8000 rpm from 16000 rpm. The solid content concentration of the UV softening material suspension A2 was 11.8%. The median diameter D50 of UV softening material microparticles in the UV softening material suspension A2 was 980 nm.

(3-1-1-3) Preparation of UV Softening Material Suspension B (Synthesis of UV Softening Material B)

50 parts of water was added to 278 parts of para-nitrophenol as a raw material, and the resultant was heated to 80° C. to be agitated, and thereby the nitrophenol was dissolved in the water. Then, to the nitrophenol aqueous solution, 184 parts of concentrated sulfuric acid and 110 parts of a 35% formaldehyde aqueous solution were added, and then the resultant mixed solution was heated to 125° C. to be agitated for 1 hour. Then, by thin-layer chromatography, disappearance of the para-nitrophenol in the mixed solution was confirmed, and then the mixed solution stood to cool at room temperature and distilled water was poured thereinto, to make a solid precipitate.

Next, the solid that had precipitated was filtered out to be dispersed in a 5% NaOH aqueous solution. Then, undissolved matters were removed by filtering, and then a basic aqueous solution being an obtained filtrate was acidified with hydrochloric acid to make a solid precipitate again. After the solid that had precipitated was filtered out to then be washed with distilled water, the resultant solid was dried by vacuum drying and 264 parts of a first intermediate represented by Chemical Formula (16) below was obtained.

Next, 261 parts of the first intermediate, 675 parts of 1-bromododecane, and 621 parts of potassium carbonate were dissolved in 4248 parts of N,N-dimethylformamide, and a first intermediate solution was obtained. Then, the first intermediate solution was heated and agitated at 80° C. for 4 hours under a nitrogen atmosphere.

Next, by thin-layer chromatography, disappearance of the first intermediate in the first intermediate solution was confirmed, and then distilled water was added to the first intermediate solution and an organic phase was extracted with hexane therefrom. The obtained organic phase was washed with distilled water one time and washed with a saturated sodium chloride aqueous solution one time, to then be dried with anhydrous magnesium sulfate.

Next, after a solid in the organic phase was removed by filtering, the resultant solvent was distilled off under reduced pressure to obtain an extract. Then, the extract was refined by silica gel column chromatography with a mixed solvent of hexane:chloroform=1:1 being a developing solvent, and 288 parts of a second intermediate represented by Chemical Formula (16) below was obtained.

Chemical Formula (16):

(16)

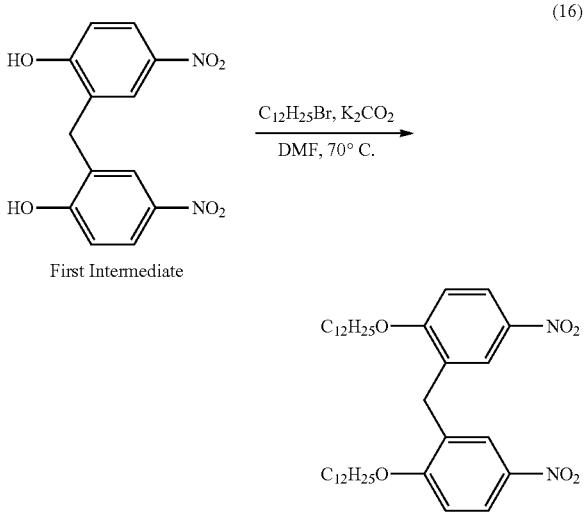

First Intermediate

Second Intermediate

Next, 28 parts of the second intermediate was dissolved in 7469 parts of anhydrous tetrahydrofuran. 237 parts of a 1.0 mol/L lithium aluminum hydride anhydrous tetrahydrofuran solution was dropped down into this solution at room temperature for about 20 minutes, and then the resultant solution was agitated at 40° C. for 3 hours. To this reaction solution, 5600 parts of distilled water was added, and then most of the tetrahydrofuran was distilled off under reduced pressure. An obtained residue was extracted with ethyl acetate. The combined organic phase was washed with distilled water one time and washed with a saturated sodium chloride aqueous solution one time, and then an anhydrous magnesium sulfate was added to the organic phase and the resultant organic phase was dried. Then, a solid was removed by filtering, and then the resultant solvent was distilled off under reduced pressure. An obtained oily residue was refined by silica gel column chromatography with a mixed solvent of hexane:ethyl acetate=20:1 being a developing solvent, and a mixture containing a plurality of cyclic oligomers was obtained. Then, the mixture containing the plurality of cyclic oligomers was further separated by gel permeation chromatography, and a UV softening material B containing monocyclic dimers, represented by Chemical Formula (17) below, was obtained.

A series of operations, namely an operation in which the second intermediate and the lithium aluminum hydride are made to react with each other and then the UV softening material B represented by Chemical Formula (17) below is refined, was performed 10 times repeatedly, and 2.8 parts of the UV softening material B represented by Chemical Formula (17) below (melting point 122° C.) was obtained.

Chemical Formula (17):

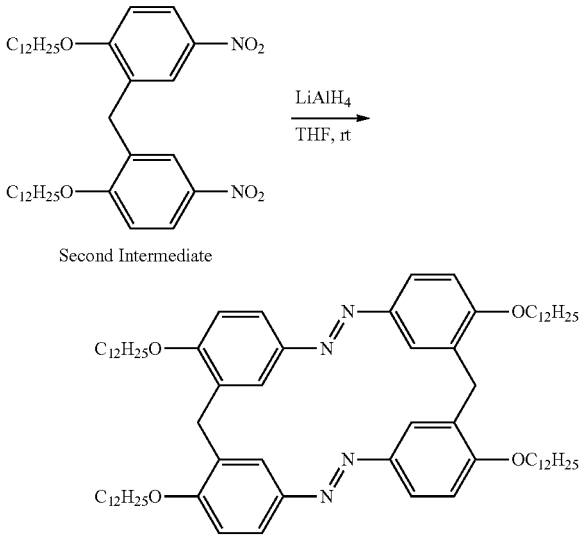

(Preparation of UV Softening Material Suspension B)

A UV softening material suspension B was prepared in the same manner as the preparation of the UV softening material suspension Al described above except that the dichloromethane was changed to 85 parts from 80 parts and 15 parts of the UV softening material B was used in place of 20 parts of the UV softening material A. The solid content concentration of the UV softening material suspension B was 10.7%. The median diameter D50 of UV softening material microparticles in the UV softening material suspension B was 310 nm.

(3-1-1-4) Preparation of Charge Control Agent Suspension

As the charge control agent, FCA-201PS produced by Fujikura Kasei Co., Ltd. was prepared.

Incidentally, the FCA-201PS is a copolymer of butyl acrylate, N,N-diethyl-N-methyl-2-(methacryloyloxy) ethylammonium=p-toluenesulfonate, and styrene, of which the content of N,N-diethyl-N-methyl-2-(methacryloyloxy) ethylammonium=p-toluenesulfonate is 14 mass %, a weight-average molecular weight Mw is 15000, and the glass transition point Tg is 66° C.

Next, 82.5 parts of methyl ethyl ketone and 17.5 parts of the charge control agent were mixed and agitated, to make the charge control agent dissolve in the methyl ethyl ketone, and a charge control agent liquid was obtained.

100 parts of distilled water was mixed in 100 parts of this charge control agent liquid, and the resultant was agitated using a homogenizer equipped with a shaft 18F at a rotation speed of 16000 rpm for 20 minutes to be emulsified, and a charge control agent emulsified liquid was obtained. Incidentally, the homogenizer is a product with product name: Silent Crusher M manufactured by Heidolph Instruments.

The obtained charge control agent emulsified liquid was transferred into a 2-L separable flask and heated and agitated at 80° C. for 120 minutes using six flat plate turbine blades with a diameter of 75 mm while blowing nitrogen into the gas phase, to volatilize and remove the methyl ethyl ketone therefrom, and a charge control agent suspension was obtained.

The solid content concentration of the charge control agent suspension was 22.3%. Further, the volume average particle diameter of charge control agent microparticles in the charge control agent suspension, namely the median diameter D50 was 110 nm.

(3-1-2) Toner Base Particle Preparation Step (3-1-2-1) Preparation of Colorant Dispersion Liquid PE 15 parts of a polyester resin, 15 parts of carbon black, and 70 parts of methyl ethyl ketone were mixed together to be agitated by a homogenizer equipped with a shaft 18F at a rotation speed of 10000 rpm for 10 minutes, and thereby a colorant was preliminarily dispersed. Incidentally, the polyester resin is a product with product name: FC1565 produced by MITSUBISHI RAYON CO., LTD. with the glass transition temperature Tg of 64° C., the number average molecular weight Mn of 4500, the weight-average molecular weight Mw of 70000, the gel content of 0.8 wt %, and the acid value of 6.0 KOHmg/g. Further, the carbon black is a product with product name: #260 produced by Mitsubishi Chemical Corporation, and the homogenizer is a product with product name: Silent Crusher M manufactured by Heidolph Instruments.

Next, 100 parts of a colorant preliminary dispersion liquid was put into a bead mill apparatus together with 450 parts of zirconia beads having a diameter of 1 mm to be processed for 60 minutes at an agitation speed of 2000 rpm, and a colorant dispersion liquid PE was obtained. Incidentally, the bead mill apparatus is a product with product name: RMB-04 manufactured by AIMEX CO., Ltd.

(3-1-2-2) Preparation of Binder Resin Liquid PE

Next, 678 parts of methyl ethyl ketone was slowly mixed in 60 parts of the colorant dispersion liquid PE, and then 162 parts of the above-described polyester resin was mixed in the resultant to be agitated, and this was heated to a liquid temperature of 70° C. and agitated, and a binder resin liquid PE was obtained.

(3-1-2-3) Preparation of Binder Resin Emulsified Liquid PE 900 parts of the obtained binder resin liquid PE, 900 parts of distilled water heated to 70° C., and 9 parts of a 1 normal aqueous sodium hydroxide solution were mixed together and agitated by a homogenizer with a shaft 22F for 20 minutes at a rotation speed of 15000 rpm, which was at 13.0 m/s in terms of the tip peripheral speed, to be emulsified, and a binder resin emulsified liquid PE was obtained.

(3-1-2-4) Preparation of Base Microparticle Suspension PE

The obtained binder resin emulsified liquid PE was transferred into a 2-L separable flask and heated and agitated at 75° C. for 140 minutes while blowing nitrogen into the gas phase, to remove the methyl ethyl ketone therefrom, and a base microparticle suspension PE in which base microparticles were dispersed was obtained. The solid content concentration of the base microparticle suspension PE was 23.0%. Further, the volume average particle diameter of the base microparticles in the base microparticle suspension PE, namely the median diameter D50 was 301 nm.

(3-1-2-5) Preparation of Toner Base Particle Suspension PE

Next, to the base microparticle suspension PE, 57.6 parts of a 5% aqueous solution of polyoxyethylene polyoxypropylene block copolymer was added as a nonionic surfactant, and then the resultant was diluted with distilled water, and 1600 parts of a diluted solution PE with a solid content concentration of 10% was obtained. Incidentally, the nonionic surfactant is a product with product name: EPAN785 produced by DKS Co. Ltd.

To this diluted solution PE, 35 parts of a 0.2 normal aluminum chloride aqueous solution was added as an aggregating agent, and the resultant was mixed and agitated using a homogenizer equipped with a shaft 22F for 10 minutes at a rotation speed of 8000 rpm.

Thereafter, the diluted solution PE to which the aggregating agent was added was heated to a solution temperature of 45° C. while being agitated using six flat plate turbine blades with a diameter of 75 mm at a rotation speed of 300 rpm, and was agitated for about 30 minutes to make the base microparticles PE aggregate. Thereafter, as an aggregation stopping agent, 46 parts of a 0.2 normal aqueous sodium hydroxide solution was added to the resultant diluted solution PE, and then the resultant diluted solution PE was heated up to a solution temperature of 90° C. and agitated for about 6.5 hours, and a toner base particle suspension PE was obtained.

Part of the obtained toner base particle suspension PE was collected to be filtered, and thereby toner base particles PE were filtered out. As for the toner base particle PE, the volume-based average particle diameter Dv thereof was 8.0 μm, a degree of circularity thereof was 0.995, and the glass transition temperature Tg thereof was 59° C.

On the other hand, the remaining toner base particle suspension PE was filtered, and the filtered out toner base particles PE were washed with distilled water, to then be put into a separable flask. Distilled water was poured into the flask to make the toner base particles PE disperse again, and the toner base particle suspension PE with a solid content of 10 mass % was obtained.

(3-1-3) Toner Preparation Step (3-1-3-1) Preparation Example 1 to Preparation Example 5

Figure 2:
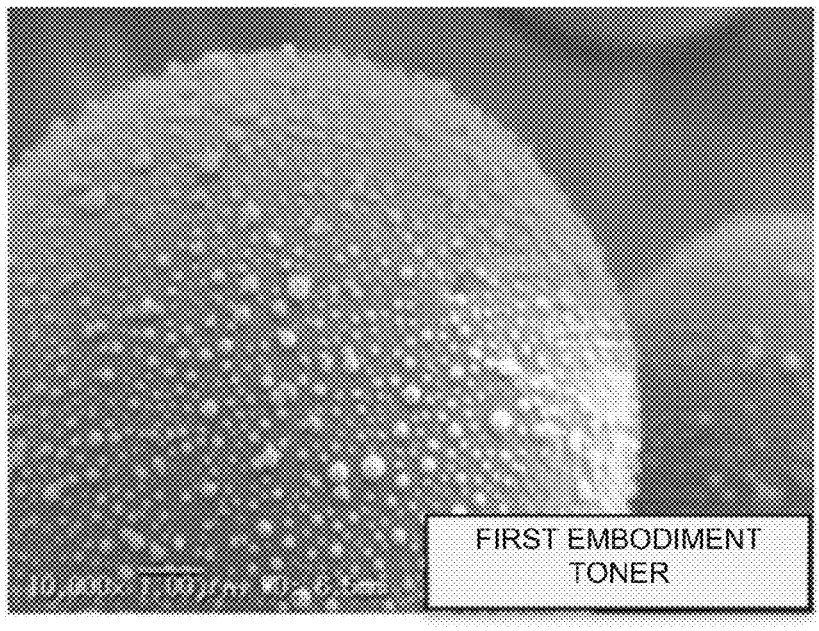
FIG. 2 is a scanning electron microscope (SEM) photograph of toner as one embodiment of a developer used in the printer shown in FIG. 1.

In a hot-water bath at 25° C., 1.3 parts of the charge control agent suspension was mixed in 500 parts of the toner base particle suspension PE while performing agitation at 200 rpm using an impeller, specifically, double six flat plate turbine blades with a diameter of 75 mm, to be agitated for 10 minutes. Thereafter, the temperature of the hot-water bath was increased up to 60° C. at a speed of 1° C./minute, and then the UV softening material suspension A1 was added to the resultant suspension under a mixing prescription shown in Table 1 and further the resultant suspension was heated and agitated for 15 minutes at 60° C. Thereby, as shown in a scanning electron microscope photograph in FIG. 2, the UV softening material A adhered to the surfaces of the toner base particles PE, and toner particles A1-1 to A1-5 were formed.

Next, the suspension with the toner particles A1-1 to A1-5 being dispersed therein was cooled down to room temperature, to then be filtered, and distilled water was added to the filtered out toner particles A1 to be subjected to filtration and washing repeatedly until conductivity of a filtrate became 4 μS/cn or less.

Thereafter, the washed toner particles A1-1 to A1-5 were dried in a dryer at 50° C. until a moisture content thereof became 0.5 mass % or less, and the dried toner particles A1-1 to A1-5 were obtained. Further, the coverage of UV softening material microparticle A1 to the surface area of the toner base particle PE was calculated from the following expression. Results are shown in Table 1.

Expression: UV softening material microparticle total projected area W1/toner total surface area W2

Incidentally, the UV softening material microparticle total projected area W1 can be calculated from projected area per one UV softening material microparticle/(volume per one UV softening material microparticle×UV softening material microparticle specific gravity)×UV softening material microparticle prepared amount. More specifically, it is the UV softening material microparticle total projected area W1[$m^2$] =π×(UV softening material microparticle radius [m])$^2$/(4π/3×(UV softening material microparticle radius [m])$^3$×UV softening material microparticle specific gravity [g/$m^3$])×UV softening material microparticle prepared amount [g].

Further, the toner total surface area W2 can be calculated by surface area per one toner particle/(volume V per one toner particle×toner particle specific gravity)×toner particle prepared amount. More specifically, it is the toner total surface area W2[$m^2$]=4π×(toner particle radius [m])$^2$/(4π/3×(toner particle radius [m])$^3$×toner particle specific gravity [g/$m^3$])× toner particle prepared amount [g]. That is, the UV softening material microparticle total projected area W1 and the toner total surface area W2 can be calculated from the particle diameters and the specific gravities of the respective particles.

Next, 1 part of hydrophobic silica, which was specifically 0.5 parts of HVK2150 produced by Clariant and 0.5 parts of NA50H produced by AEROSIL, was mixed with 50 parts of the dried toner particles A1-1 to A1-5 to be agitated for 3 minutes at a rotation speed of 2500 rpm using a MECHANOMILL manufactured by OKADA SEIKO CO., LTD. Thereafter, coarse aggregates of the hydrophobic silica were removed using a sieve to obtain toners A1-1 to A1-5.

(3-1-3-2) Preparation Example 6 to Preparation Example 8

Toner particles A2-1 to A2-3 were obtained in the same manner as in Preparation examples 1 to 5 except that in place of the UV softening material suspension A1, the UV softening material suspension A2 was added under the mixing prescription shown in Table 1. Further, the coverage of UV softening material microparticle A2 to the surface area of the toner base particle PE was calculated from the above-described expression. Results are shown in Table 1.

Then, 0.5 parts of HVK2150 produced by Clariant and 0.5 parts of NA50H produced by AEROSIL were mixed with 50 parts of the dried toner particles A2-1 to A2-3 to be agitated for 3 minutes at a rotation speed of 2500 rpm using a MECHANOMILL. Thereafter, coarse aggregates of hydrophobic silica were removed using a sieve to obtain toners A2-1 to A2-3.

(3-1-3-3) Preparation Example 9 to Preparation Example 11

Toner particles B1-1 to B1-3 were obtained in the same manner as in Preparation examples 1 to 5 except that in place of the UV softening material suspension A1, the UV softening material suspension B was added under the mixing prescription shown in Table 1. Further, the coverage of UV softening material microparticle B to the surface area of the toner base particle PE was calculated from the above-described expression. Results are shown in Table 1.

Then, 0.5 parts of HVK2150 produced by Clariant and 0.5 parts of NA50H produced by AEROSIL were mixed with 50 parts of the dried toner particles B1-1 to B1-3 to be agitated for 3 minutes at a rotation speed of 2500 rpm using a MECHANOMILL. Thereafter, coarse aggregates of hydrophobic silica were removed using a sieve to obtain toners B1-1 to B1-3.

(3-2) Preparation Example 12 and Preparation Example 13

(3-2-1) Additive Preparation Step (3-2-1-1) Preparation of Charge Control Agent Suspension A charge control agent suspension was prepared in the same manner as the preparation of the charge control agent suspension in Preparation examples 1 to 11

(3-2-2) Toner Base Particle Preparation Step (3-2-2-1) Toner Base Particle Suspension A (Preparation of Colorant Dispersion Liquid A)

15 parts of the UV softening material A represented by Chemical Formula (7) above, 15 parts of carbon black, and 70 parts of dichloromethane were mixed together to be agitated by a homogenizer equipped with a shaft 18F at a rotation speed of 10000 rpm for 10 minutes, and thereby a colorant was preliminarily dispersed. Incidentally, the carbon black is a product with product name: #260 produced by Mitsubishi Chemical Corporation, and the homogenizer is a product with product name: Silent Crusher M manufactured by Heidolph Instruments.

Next, 100 parts of a colorant preliminary dispersion liquid was put into a bead mill apparatus together with 450 parts of zirconia beads having a diameter of 1 mm to be processed for 60 minutes at an agitation speed of 2000 rpm, and a colorant dispersion liquid A was obtained. The bead mill apparatus is a product with product name: RMB-04 manufactured by AIMEX CO., Ltd.

(Preparation of Binder Resin Liquid A)

Next, 226 parts of dichloromethane was slowly mixed in 20 parts of the colorant dispersion liquid A, and then 54 parts of the UV softening material A represented by Chemical Formula (7) above was mixed in the mixed resultant to be agitated while being heated at 40° C., and a binder resin liquid A was obtained.

(Preparation of Binder Resin Emulsified Liquid A)

Next, 300 parts of the binder resin liquid A was mixed in a mixture of 1387.5 parts of distilled water warmed to 40° C. and 112.5 parts of a tricalcium phosphate 10% dispersion liquid to be agitated by a CLEARMIX for 10 minutes at a rotation speed of 4500 rpm to be emulsified, and a binder resin emulsified liquid A was obtained. Incidentally, the CLEARMIX is manufactured by M Technique Co., Ltd. with a rotor R1 and a screen S1.5-24, and the tricalcium phosphate 10% dispersion liquid is a product with product name: TCP-10•U produced by Taihei Chemical Industrial Co. Ltd.

(Preparation of Base Microparticle Suspension A)

The binder resin emulsified liquid A was transferred into a 2-L separable flask and heated and agitated at 40° C. for 140 minutes while blowing nitrogen into the gas phase, to remove an organic solvent therefrom, and a base microparticle dispersion liquid A in which toner base particles A3 were dispersed was obtained.

Part of the obtained base microparticle dispersion liquid A was collected to then be filtered, and thereby the toner base particles A3 were filtered out. As for the toner base particle A3, the volume-based average particle diameter Dv thereof was 7.9 μm, a degree of circularity thereof was 0.992, and the glass transition temperature Tg thereof was 74° C.

(Preparation of Toner Base Particle Suspension A)

On the other hand, the remaining base microparticle dispersion liquid A was filtered, and the filtered out toner base particles A3 were dispersed in 3300 parts of 0.06 normal hydrochloric acid to be agitated for 2 hours, to thereby dissolve the tricalcium phosphate on the surfaces of the toner base particles A3. Thereafter, the hydrochloric acid in which the toner base particles A3 were dispersed was filtered, and the filtered out toner base particles A3 were washed with distilled water, to then be dispersed in distilled water again, and a toner base particle suspension A with a solid content concentration of 10% was obtained.

(3-2-2-2) Toner Base Particle Suspension B (Preparation of Colorant Dispersion Liquid B)

A colorant dispersion liquid B was prepared in the same manner as the preparation of the colorant dispersion liquid A except that in place of 15 parts of the UV softening material A represented by Chemical Formula (7) above, 15 parts of the UV softening material B represented by Chemical Formula (17) above was used.

(Preparation of Binder Resin Liquid B)

Next, 226 parts of dichloromethane was slowly mixed in 20 parts of the colorant dispersion liquid B, and then 54 parts of the UV softening material B represented by Chemical Formula (17) above was mixed in the mixed resultant to be agitated while being heated at 40° C., and a binder resin liquid B was obtained.

(Preparation of Binder Resin Emulsified Liquid B)

Next, 300 parts of the binder resin liquid B was mixed in a mixture of 1365 parts of distilled water warmed to 40° C. and 135 parts of the above-described tricalcium phosphate 10% dispersion liquid to be agitated by the above-described CLEARMIX for 15 minutes at a rotation speed of 4500 rpm to be emulsified, and a binder resin emulsified liquid B was obtained.

(Preparation of Base Microparticle Suspension B)

The binder resin emulsified liquid B was transferred into a 2-L separable flask and heated and agitated at 40° C. for 140 minutes while blowing nitrogen into the gas phase, to remove an organic solvent therefrom, and a base microparticle dispersion liquid B in which toner base particles B2 were dispersed was obtained.

Part of the obtained base microparticle dispersion liquid B was collected to be filtered, and thereby the toner base particles B2 were filtered out. As for the toner base particle B2, the volume-based average particle diameter Dv thereof was 8.3 μm, a degree of circularity thereof was 0.993, and the glass transition temperature Tg thereof was 79° C.

(Preparation of Toner Base Particle Suspension B)

On the other hand, the remaining base microparticle dispersion liquid B was filtered, and the filtered out toner base particles B2 were dispersed in 4000 parts of 0.06 normal hydrochloric acid to be agitated for 2 hours, to thereby dissolve the tricalcium phosphate on the surfaces of the toner base particles B2. Thereafter, the hydrochloric acid in which the toner base particles B2 were dispersed was filtered, and the filtered out toner base particles B2 were washed with distilled water, to then be dispersed in distilled water again, and a toner base particle suspension B with a solid content concentration of 10% was obtained.

(3-2-3) Toner Preparation Step (3-2-3-1) Preparation Example 12

In a hot-water bath at 25° C., 1.3 parts of the charge control agent suspension A was mixed in 500 parts of the toner base particle suspension A while performing agitation at 200 rpm using an impeller, specifically, double six flat plate turbine blades with a diameter of 75 mm, to be agitated for 10 minutes. Thereafter, the temperature of the hot-water bath was increased up to 60° C. at a speed of 1° C./minute, to set the liquid temperature of a mixture of the toner base particle suspension A and the charge control agent suspension A to 60° C., and then the resultant mixture was further heated and agitated for 15 minutes. Next, this mixture was cooled down to room temperature, to then be filtered, and distilled water was added to the filtered out toner particles A3 to be subjected to filtration and washing repeatedly until conductivity of a filtrate became 4 μS/cm or less.

Thereafter, the washed toner particles were dried in a dryer at 50° C. until a moisture content thereof became 0.5 mass % or less, and then 1 part of hydrophobic silica, which was specifically 0.5 parts of HVK2150 produced by Clariant and 0.5 parts of NA50H produced by AEROSIL, was mixed with 50 parts of the dried toner particles A3 to be agitated for 3 minutes at a rotation speed of 2500 rpm using a MECHANOMILL manufactured by OKADA SEIKO CO., LTD. Thereafter, coarse aggregates of the hydrophobic silica were removed using a sieve to obtain a toner A3.

(3-2-3-2) Preparation Example 13

A toner B2 was prepared in the same manner as in Preparation example 12 except that in place of the toner base particle suspension A, the toner base particle suspension B was used.

(3-3) Various Physical Property Test Methods (3-3-1) Measurement Method of Solid Content 2 to 20 g of a measuring object was collected in an aluminum container, mass before being dried was measured, the measuring object was dried in a dryer at 50° C., and mass of a non-volatile content was measured. A percentage of the mass of a non-volatile content to the mass before being dried was calculated as a solid content.

(3-3-2) Measurement of Average Particle Diameters of Charge Control Agent Microparticle, UV Softening Material Microparticle, and Base Microparticle By using a Nanotrac particle size distribution measuring apparatus, the volume average particle diameter of charge control agent microparticles in the charge control agent suspension, the volume average particle diameter of UV softening material microparticles in the UV softening material suspension, and the volume average particle diameter of base microparticles in the base microparticle suspension were measured. Incidentally, the Nanotrac particle size distribution measuring apparatus is a product with product name: UPA150 manufactured by NIKKISO CO., LTD.

Pure water was used for a diluted solvent, and the refractive index of the solvent was set to 1.33. Further, the refractive index of the charge control agent microparticle was set to 1.51, the refractive index of the UV softening material microparticle was set to 1.51, and the refractive index of the base microparticle was set to 1.91.

Several drops of one of the charge control agent suspension, the UV softening material suspension, and the base microparticle suspension were introduced into a measuring unit of the Nanotrac particle size distribution measuring apparatus using a dropper so as to fall within an appropriate concentration range of measurement conditions, and the measurement was performed for a measurement time of 60 seconds. The median diameter D50 of an average value obtained after the same sample was measured three times was set as a representative value of the volume average particle diameter.

(3-3-3) Measurement of Average Particle Diameter of Toner Base Particle

A particle size distribution measuring apparatus was used. Incidentally, the particle size distribution measuring apparatus is a product with product name: Coulter Multisizer III manufactured by Beckman Coulter. Further, one with an aperture diameter of 100 μm was used and the measurement was performed.

0.2 g of toner base particles obtained by drying the toner base particle suspension was dispersed, or ultrasonically dispersed as necessary, in 50 ml of distilled water using a dispersing agent, and a slurry sample was prepared. Incidentally, the dispersing agent is a product with product name: PELEX OT-P produced by Kao Corporation.

Next, 3 to 5 drops of the sample were introduced into a measuring device of the particle size distribution measuring apparatus with a 2-ml dropper, and the volume-based average particle diameter Dv of about 50000 pieces of particles was measured.

(3-3-4) Fixation Test (3-3-4-1) Fixation Test Method 1

A printer obtained by excluding the fixing unit 14 from the printer 1 shown in FIG. 1 was prepared, and each of the developing cartridges 3, in which the toners A1-1 to A1-5, the toners A2-1 to A2-3, and the toner A3 of Preparation examples 1 to 8, and 12 were accommodated individually, was installed in the main body casing 41 of the printer.

Next, the printer executed the later-described image forming operation, and 6 sheets of printed matter, each of which was not yet subjected to fixing and had a square image having a size of 10 mm×10 mm provided on the center of the printing paper P, were collected. Then, a reflection density OD1 of the square image before being fixed was measured by a spectrophotometer. Incidentally, the spectrophotometric measuring apparatus is a product with product name: SpectroEye manufactured by X-Rite. Further, in the printer, a developing bias was adjusted so that the reflection density OD1 became 1.29 to 1.31. Next, ultraviolet light having 365 nm (30 mW/cm$^2$) was emitted to each of the unfixed printing matters at about 25° C. using an LED light source manufactured by Nichia Corporation for the time sufficient for softening, specifically, for 10 minutes or longer. Subsequently, visible light having 510 nm (30 mW/cm$^2$) was emitted to each of them at 25° C. using an LED light source for the time sufficient for hardening, specifically, for 10 minutes or longer. Thereby, the square image was fixed to the center portion of each of the printing papers P.

Then, each of the portions, of the printing papers P, to which the square image was fixed was rubbed forward and backward five times with a cloth while 300 g of load was applied, and then a reflection density OD2 of each of the portions after being fixed was measured.

Then, a reflection density decrease rate [%] was calculated from Expression (18) below.

$$\text{Reflection density decrease rate [\%]} = (\text{reflection density OD1} - \text{reflection density OD2}) / \text{reflection density OD1} \times 100 \quad \text{Expression (18):}$$

Figure 3:
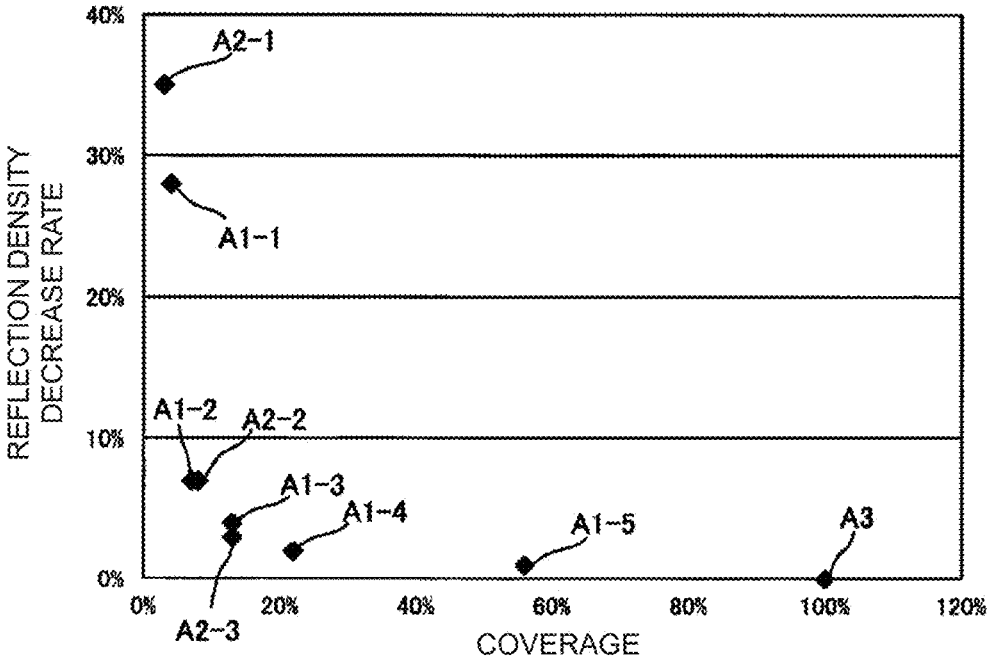
FIG. 3 is a graph showing a correlation between a coverage of UV softening material to a surface area of a toner base particle in a toner evaluated by a fixation test method 1 and a reflection density decrease rate by the fixation test method 1.

One with the average value of the reflection density decrease rate of the 6 printing papers being 10% or more to less than 45% was judged as "±", one with the average value being 6% or more to less than 10% was judged as "+", and one with the average value being less than 6% was judged as "++". Results thereof are shown in FIG. 3 and Table 2.

(3-3-4-2) Fixation Test Method 2

In the same manner as in the fixation test method 1 described above, a printer obtained by excluding the fixing unit 14 from the printer 1 shown in FIG. 1 was prepared, and by using each of the developing cartridges 3 in which the toners A1-1 to A1-5, the toners A2-1 to A2-3, the toners B1-1 to B1-3, the toner A3, and the toner B2 of Preparation examples 1 to 13 were loaded individually, 6 sheets of unfixed printing matter, each of which the reflection density OD1 was 1.29 to 1.31, were collected in the same manner as the above.

Next, ultraviolet light having 365 nm (30 mW/cm$^2$) was emitted to each of the unfixed printing matters at about 25° C. using an LED light source manufactured by Nichia Corporation for the time sufficient for softening, specifically, for 10 minutes or longer. Subsequently, each of them was heated to 40° C. for the time sufficient for hardening, specifically, for 1 hour or longer. Thereby, the square image was fixed to the center portion of each of the printing papers P.

Figure 4:
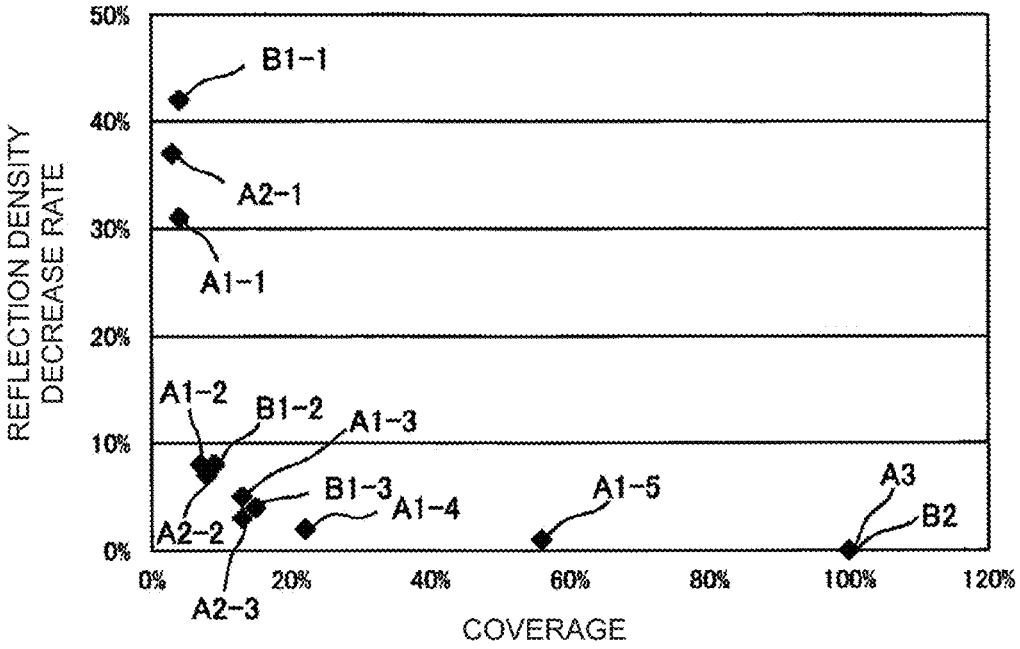
FIG. 4 is a graph showing a correlation between a coverage of UV softening material to a surface area of a toner base particle in a toner evaluated by a fixation test method 2 and a density decrease rate by the fixation test method 2.

Then, each of the portions, of the printing papers P, to which the square image was fixed was rubbed forward and backward five times with a cloth while 300 g of load was applied, and then each reflection density decrease rate (%) was calculated by Expression (18) above, and then the calculated resultants were evaluated in the same manner as the above. Results thereof are shown in FIG. 4 and Table 3.

TABLE 1

| | Mixing Prescription | | | | |
|---|---|---|---|---|---|
| Preparation Example | UV Softening Material Suspension A1 [Part By Mass] | UV Softening Material Suspension A2 [Part By Mass] | UV Softening Material Suspension B [Part By Mass] | Toner Particle | Coverage [%] |
| 1 | 2 | — | — | A1-1 | 4 |
| 2 | 3 | — | — | A1-2 | 7 |
| 3 | 6 | — | — | A1-3 | 13 |
| 4 | 10 | — | — | A1-4 | 22 |
| 5 | 25 | — | — | A1-5 | 56 |
| 6 | — | 6 | — | A2-1 | 3 |
| 7 | — | 15 | — | A2-2 | 3 |
| 8 | — | 25 | — | A2-3 | 13 |
| 9 | — | — | 3 | B1-1 | 4 |
| 10 | — | — | 6 | B1-2 | 9 |
| 11 | — | — | 10 | B2-3 | 15 |

TABLE 2

| | | | Fixation Test Method 1 | |
|---|---|---|---|---|
| Preparation Example | Toner Particle | Coverage [%] | Reflection Density Decrease Rate [%] | Judgment |
| 1 | A1-1 | 4 | 28 | ± |
| 2 | A1-2 | 7 | 7 | + |
| 3 | A1-3 | 13 | 5 | ++ |
| 4 | A1-4 | 22 | 2 | ++ |
| 5 | A1-5 | 56 | 1 | ++ |
| 6 | A2-1 | 3 | 35 | ± |
| 7 | A2-2 | 8 | 7 | + |
| 8 | A2-3 | 13 | 3 | ++ |
| 12 | A3 | 100 | 0 | ++ |

TABLE 3

| | | | Fixation Test Method 2 | |
|---|---|---|---|---|
| Preparation Example | Toner Particle | Coverage [%] | Reflection Density Decrease Rate [%] | Judgment |
| 1 | A1-1 | 4 | 31 | ± |
| 2 | A1-2 | 7 | 8 | + |
| 3 | A1-3 | 13 | 5 | ++ |
| 4 | A1-4 | 22 | 2 | ++ |
| 5 | A1-5 | 56 | 1 | ++ |
| 6 | A2-1 | 3 | 37 | ± |
| 7 | A2-2 | 8 | 7 | + |
| 8 | A2-3 | 13 | 4 | ++ |
| 9 | B1-1 | 4 | 42 | ± |
| 10 | B1-2 | 9 | 8 | + |
| 11 | B1-3 | 15 | 4 | ++ |
| 12 | A3 | 100 | 0 | ++ |
| 13 | B2 | 100 | 0 | ++ |

The result in Table 2 reveals that when the toner particles are softened by ultraviolet light emission and then are hardened by visible light emission, the toner can be fixed to the printing paper without using a normal fixing unit. Particularly, it reveals that when the coverage of the softening material to the toner particle is 7% or more, and particularly 13% or more, good fixation can be achieved.

Further, the result in Table 3 reveals that when the toner particles are softened by ultraviolet light emission and then are hardened by heating, each type of the toners can be fixed to the printing paper without using a normal fixing unit. Particularly, it reveals that when the coverage of the softening material to the toner particle is 7% or more, and particularly 13% or more, good fixation can be achieved.

3. Image Forming Operation

The toner in the casing 7 is supplied to the developing roller 4 by rotation of the supply roller 5. At this time, the toner is positively frictionally charged between the supply roller 5 and the developing roller 4, the thickness of the toner is regulated by the layer thickness regulating blade 6, and the toner is carried on the circumferential surface of the developing roller 4 as a thin layer having a fixed thickness.

Meanwhile, the surface of the photosensitive drum 2 is positively charged uniformly by the scorotron charger 10 with rotation of the photosensitive drum 2. Then, a laser beam from the scanner unit 8 is selectively emitted onto the surface of the positively-charged photosensitive drum 2, and thereby an electrostatic latent image based on image data is formed.

Then, the positively-charged toner carried on the surface of the developing roller 4 is supplied to the electrostatic latent image formed on the surface of the photosensitive drum 2, and thereby a toner image is carried on the surface of the photosensitive drum 2. The toner image carried on the surface of the photosensitive drum 2 is transported toward a nip position between the photosensitive drum 2 and the transfer roller 9 with rotation of the photosensitive drum 2.

The printing papers P are accommodated in the paper feed tray 43 and are transported by the various rollers so as to make a U-turn, and are fed to the space between the photosensitive drum 2 and the transfer roller 9 one by one at a predetermined timing. Then, a first surface being the photosensitive drum 2 side of the printing paper P comes into contact with the toner image carried on the surface of the photosensitive drum 2 at the nip position between the photosensitive drum 2 and the transfer roller 9. In other words, when the toner image carried on the surface of the photosensitive drum 2 arrives at the nip position between the photosensitive drum 2 and the transfer roller 9, the toner image is positioned at a contact position to come into contact with the first surface of the printing paper P.

At this time, by a transfer bias to be applied to the transfer roller 9, the toner image is transferred onto the first surface of the printing paper P.

Then, the printing paper P having had the toner image transferred thereonto passes under the ultraviolet LED 11. At this time, the toner image transferred onto the first surface of the printing paper P faces the ultraviolet LED 11 and ultraviolet light from the ultraviolet LED 11 is emitted to the toner image. That is, the ultraviolet LED 11 emits ultraviolet light having a wavelength of 300 nm or more to less than 400 nm to the toner image transferred onto the printing paper P. Thereby, the UV softening material positioned on the surface of the toner is melted (or fluidized) to fusion-adhere to the first surface of the printing paper P.

Next, the printing paper P is transported to the space between the heating roller 12 and the pressing roller 13. Then, the printing paper P, when passing through the space between the heating roller 12 and the pressing roller 13, is pressed. That is, a roller pair of the heating roller 12 and the pressing roller 13 functions as one example of the pressing member to press the printing paper P holding the toner image exposed by the ultraviolet LED 11 thereon with or without heating by the heating roller 12.

Thereby, the melted (fluidized) UV softening material is pressed toward the first surface of the printing paper P to adhere closely to the first surface of the printing paper P.

Here, when the UV softening material contains the discotic liquid crystalline compound represented by General Formula (4) above, the heating roller 12 is heated and the printing paper P is heated and pressed when passing through the space between the heating roller 12 and the pressing roller 13. In this case, the melted (fluidized) UV softening material is pressed toward the first surface of the printing paper P and solidifies to adhere to the first surface of the printing paper P. Thereby, the toner image is fixed to the first surface of the printing paper P. The heating by the heating roller 12 is performed at a temperature of 30° C. or higher and lower than the melting point of the discotic liquid crystalline compound. When the UV softening material contains the sugar alcohol ester represented by General Formula (1) above or General Formula (2) above, the heating roller 12 may be heated, or does not have to be heated. When the UV softening material is not heated by the heating roller 12, the printing paper P is pressed when passing through the space between the heating roller 12 and the pressing roller 13, and the melted UV softening material is pressed toward the first surface of the printing paper P. When the toner being a developer contains the binder resin in addition to the UV softening material, by heating the heating roller 12, the binder resin is melted or softened, resulting in that the fixation of the toner can be more secure.

Next, when the toner image on the printing paper P arrives under the visible LED 16, visible light from the visible LED 16 is emitted to the toner image. That is, the visible LED 16 emits visible light having a wavelength of not less than 400 nm nor more than 800 nm to the toner image to which the ultraviolet light has been emitted. Here, when the UV softening material contains the sugar alcohol ester represented by General Formula (1) above or General Formula (2) above, the melted UV softening material securely solidifies to adhere to the first surface of the printing paper P. Therefore, the toner image is securely fixed to the first surface of the printing paper P. When the UV softening material contains the discotic liquid crystalline compound represented by General Formula (4) above, since the UV softening material has solidified by the heated heating roller 12, the visible light does not have to be emitted by the visible LED 16.

Incidentally, during the image forming operation, the temperature inside the main body casing 41 is set to, for example, 10° C. or higher and preferably 25° C. or higher, and for example, 60° C. or lower and preferably 50° C. or lower.

Thereafter, the printing paper P to which the toner image has been fixed is transported toward the paper discharge rollers 44, to then be discharged onto the paper discharge tray 45 by the paper discharge rollers 44.

4. Function and Effect (1) In the printer 1, the toner contains a photo-reactive compound that causes cis-trans isomerization reaction by light absorption to induce phase transition, namely the UV softening material, and therefore, emitting light to the toner makes it possible to melt or solidify the UV softening material.

Therefore, the ultraviolet LED 11 emits ultraviolet light having a wavelength of 300 nm or more to less than 400 nm to the toner, to thereby melt the UV softening material, and then the UV softening material is solidified, and thereby the toner can be fixed to the printing paper P. As a result, it is possible to achieve conservation of energy as compared to the case where heating is required for melting the toner (or the binder resin) when the toner is fixed to the printing paper P.

Further, the roller pair of the heating roller 12 and the pressing roller 13 presses the printing paper P holding the toner image exposed by the ultraviolet LED 11 thereon. Therefore, it is possible to make the toner image adhere closely to the printing paper P, and further it is possible to achieve an improvement in fixation of the toner image to the printing paper P.

Consequently, according to the printer 1, it is possible to achieve an improvement in fixation of the toner image to the printing paper P while being able to achieve conservation of energy during the image forming operation, specifically when the toner is fixed to the printing paper P.

(2) Further, the visible LED 16 emits visible light having a wavelength of not less than 400 nm nor more than 800 nm to the toner image to which the ultraviolet light from the ultraviolet LED 11 has been emitted. That is, the visible LED 16 can emit visible light to the UV softening material melted by ultraviolet light emission. Therefore, it is possible to securely solidify the UV softening material melted once.

(3) Further, the ultraviolet LED 11 can melt the toner by exposing the toner image transferred onto the printing paper P. Therefore, it is possible to securely fix the toner image to the printing paper P.

(4) Further, the heating roller 12 can heat the toner image transferred onto the printing paper P as necessary when the printing paper P passes through the space between the heating roller 12 and the pressing roller 13. Therefore, it is possible to solidify the UV softening material melted by the ultraviolet light emission from the ultraviolet LED 11 by heating. As a result, it is possible to achieve a further improvement in fixation of the toner to the printing paper P.

(5) Further, when the toner contains the sugar alcohol ester represented by General Formula (1) or General Formula (2) above, the melted UV softening material can be solidified fully only by the visible LED 16. Therefore, the heating roller 12 does not have to be configured to be heatable. As a result, simplification of the printer 1 can be achieved, and additionally, further conservation of energy when the toner is fixed to the printing paper P can be achieved. Alternatively, on/off of the heating roller 12 and on/off of the visible LED 16 are appropriately changed over by a controller or the like of the printer 1 depending on the type of toner, thereby making it possible to decrease power consumption of the printer 1.

Next, there will be explained a second embodiment of the present teaching.

Figure 5:
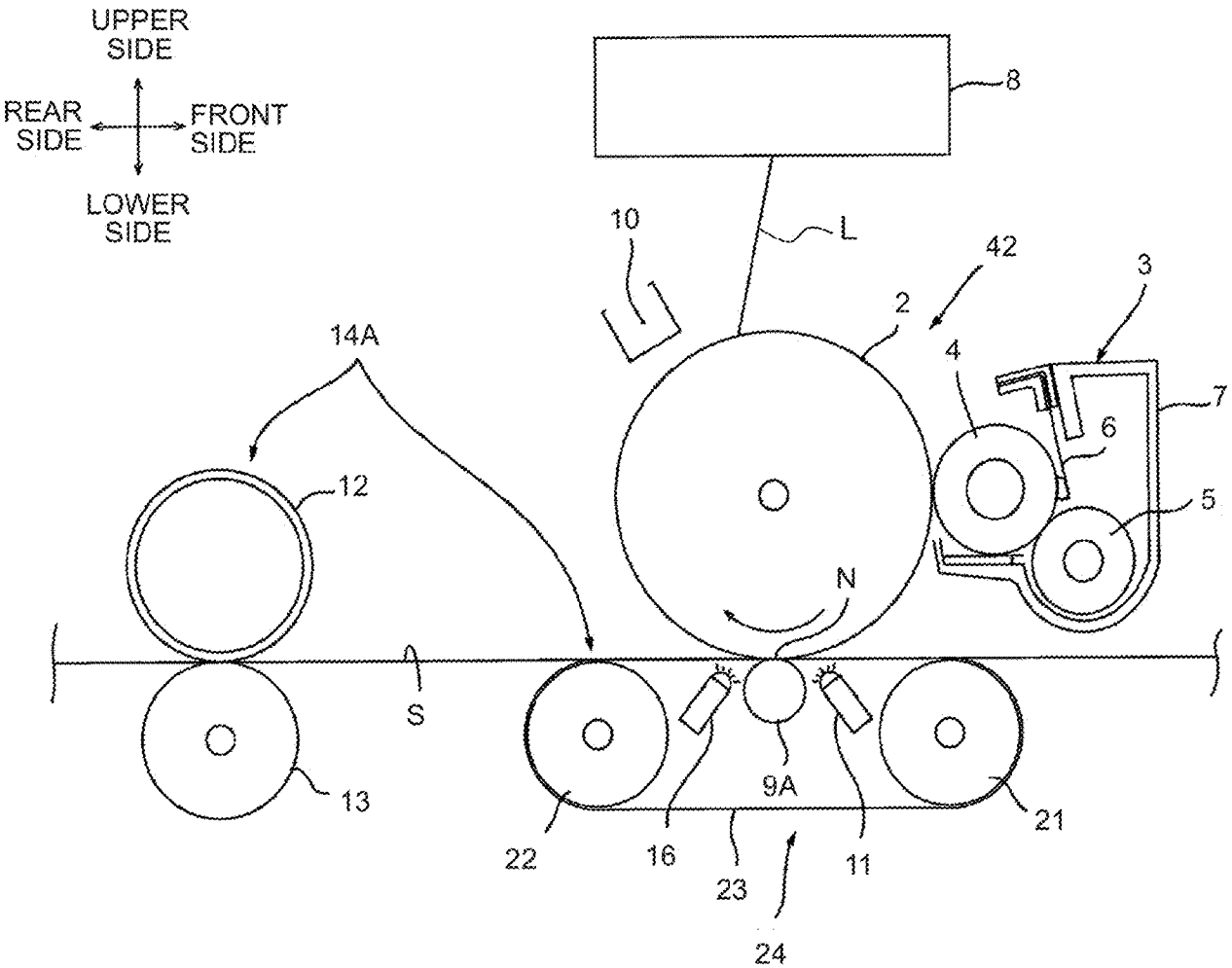
FIG. 5 is a central cross-sectional view of a printer as a second embodiment of the image forming apparatus of the present teaching.

FIG. 5 is a central cross-sectional view of a printer as the second embodiment of the image forming apparatus of the present teaching. In FIG. 5, to the parts corresponding to the respective parts shown in FIG. 1, the same reference numerals and symbols as those of the respective parts are given, and their explanations are omitted.

In the first embodiment, as shown in FIG. 1, the fixing unit 14 includes: the ultraviolet LED 11; the heating roller 12; the pressing roller 13; and the visible LED 16, but in the second embodiment, as shown in FIG. 5, a fixing unit 14A includes a belt unit 24 in addition to these. Providing the belt unit 24 can prevent a printing paper from interfering with the ultraviolet LED 11 and the visible LED 16 arranged adjacently to each other under the photosensitive drum 2 at the time of printing paper transportation.

The belt unit 24 is adjacently arranged under the photosensitive drum 2, and includes: a driving roller 22; a driven roller 21; and a transportation belt 23. The driving roller 22 and the driven roller 21 are arranged in the front-rear direction with a space left therebetween. The transportation belt 23 is formed of a material transmitting ultraviolet light having a wavelength of 300 nm or more to less than 400 nm and transmitting visible light having a wavelength of not less than 400 nm nor more than 800 nm, and is formed of a well-known transparent resin material, for example.

Further, the transportation belt 23 is stretched around the driving roller 22 and the driven roller 21 so that an upper side portion of the transportation belt 23 is sandwiched between the photosensitive drum 2 and a transfer roller 9A. The transportation belt 23 is circumferentially moved by driving of the driving roller 22 and the following driving of the driven roller 21 in the image forming operation so that the upper side portion of the transportation belt 23 sandwiched between the photosensitive drum 2 and the transfer roller 9A moves from the front side toward the rear side.

The transfer roller 9A is arranged in the space surrounded by the transportation belt 23 when viewed in the left-right direction, and is pressed against the photosensitive drum 2 from below so as to sandwich the upper side portion of the transportation belt 23 with the photosensitive drum 2. Further, the transfer roller 9A is configured so that a circumferential surface of the transfer roller 9A is heated to, for example, 25 to 100° C. and preferably 40 to 80° C. during the image forming operation. That is, in the second embodiment, the transfer roller 9A functions as the heating member and the pressing member.

The ultraviolet LED 11 is arranged in the space surrounded by the transportation belt 23 when viewed in the left-right direction, and is arranged between the driven roller 21 and the transfer roller 9A in the front-rear direction. Further, the ultraviolet LED 11 is arranged to emit the above-described ultraviolet light to the rear upper side toward a nip position N being the position where the transportation belt 23 is sandwiched between the photosensitive drum 2 and the transfer roller 9A, or a surface region of the photosensitive drum 2 positioned forward with respect to the nip position N. The ultraviolet LED 11 is positioned on the transporting direction upstream side of an OHP sheet S with respect to the nip position N, and is arranged to emit the ultraviolet light toward the nip position N or toward a region of the OHP sheet S positioned rearward with respect to the nip position N from the transporting direction upstream side of the OHP sheet S.

The visible LED 16 is arranged in the space surrounded by the transportation belt 23 when viewed in the left-right direction, and is arranged between the transfer roller 9A and the driving roller 22 in the front-rear direction. Further, the visible LED 16 is arranged to emit the above-described visible light to the front upper side toward the nip position N between the photosensitive drum 2 and the transfer roller 9A. The visible LED 16 is positioned on the transporting direction downstream side of the OHP sheet S with respect to the nip position N, and is arranged to emit the visible light toward the nip position N from the transporting direction downstream side of the OHP sheet S. That is, the ultraviolet LED 11 and the visible LED 16 are arranged on the upstream side and the downstream side in the transporting direction of the OHP sheet S respectively across the nip position or the position where the toner image is transferred onto the OHP sheet S, and emit light from the upstream side and the downstream side. Incidentally, regarding the nip position, the nip has a finite length because the photosensitive drum 2 and the transfer roller 9A are biased toward each other to come into contact with each other, and therefore the ultraviolet light is first emitted to the toner image, and then the visible light is emitted to the toner image.

In the second embodiment as above, it is possible to form an image on the OHP sheet S, which is one example of the recording sheet made of a transparent resin, for example.

More specifically, the OHP sheet S is fed to the space between the photosensitive drum 2 and the transfer roller 9A in the image forming operation. In the meantime, the toner image carried on the surface of the photosensitive drum 2 is brought by rotation of the photosensitive drum 2 to a contact position where the toner image comes into contact with the first surface being the photosensitive drum 2 side of the OHP sheet S.

At this time, the toner image existing at the contact position is transferred onto the first surface of the OHP sheet S by a transfer bias applied to the transfer roller 9A, and the ultraviolet light from the ultraviolet LED 11 is emitted thereto. That is, the ultraviolet LED 11 is arranged on the side opposite to the photosensitive drum 2 with respect to the toner image existing at the contact position, and emits the above-described ultraviolet light toward the contact position or the toner image existing immediately before the contact position.

Thereby, the UV softening material contained in the toner image existing at the contact position is melted by the ultraviolet light emission from the ultraviolet LED 11, and is transferred onto the first surface of the OHP sheet S by the transfer roller 9A.

Here, the visible LED 16 is arranged to emit the above-described visible light toward the toner image existing at the contact position (or immediately after the contact position). Therefore, when the UV softening material contains the sugar alcohol ester represented by General Formula (1) or General Formula (2) above, the melted UV softening material contained in the toner image existing at the contact position solidifies immediately to adhere to the first surface of the OHP sheet S.

Further, the OHP sheet S, when passing through the space between the photosensitive drum 2 and the transfer roller 9A, is heated and pressed. Thereby, the UV softening material is pressed toward the first surface of the OHP sheet S and solidifies securely to adhere to the first surface of the OHP sheet S.

According to the second embodiment as above, the ultraviolet LED 11 emits ultraviolet light toward the toner image existing at the contact position, and thereby the UV softening material contained in the toner image existing at the contact position is melted. Therefore, when the toner image and the first surface of the OHP sheet S come into contact with each other, it is possible to melt the UV softening material to make the toner image fusion-adhere to the first surface of the OHP sheet S securely. As a result, it is possible to transfer the toner image onto the first surface of the OHP sheet S further securely.

Further, immediately after the ultraviolet light emission, the visible LED 16 emits visible light toward the toner image existing at the contact position, thereby making it possible to solidify the melted UV softening material at the contact position. That is, the UV softening material contained in the toner image existing at the contact position is transferred onto the OHP sheet S by the transfer roller 9A and is melted by the ultraviolet light emission from the ultraviolet LED 11, and then is immediately solidified by the visible light emission from the visible LED 16.

Therefore, the UV softening material is prevented from moving with the OHP sheet S in a melted state. As a result, it is possible to prevent a foreign matter from attaching to the melted UV softening material.

Further, the transfer roller 9A works also as the heating member, thereby making it possible to securely solidify the UV softening material contained in the toner while being able to transfer the toner onto the OHP sheet S. Therefore, heating by the heating roller 12 arranged on the downstream side of the transfer roller 9A does not have to be performed, or the heating roller 12 may also be replaced with a roller having no heating operation.

Further, the transfer roller 9A works also as the pressing member, thereby making it possible to make the UV softening material contained in the toner adhere closely to the OHP sheet S securely while being able to transfer the toner onto the OHP sheet S. Therefore, the heating roller 12 and the pressing roller 13 arranged on the downstream side of the transfer roller 9A may also be eliminated. As a result, simplification of the printer 1 can be achieved, and additionally, further conservation of energy when the toner is fixed to the OHP sheet S can be achieved.

Further, when the UV softening material contains the sugar alcohol ester represented by General Formula (1) or General Formula (2) above, the melted UV softening material can be fully solidified only by the visible LED 16. Therefore, the transfer roller 9A does not have to be configured to be heatable. As a result, simplification of the printer 1 can be achieved, and additionally, further conservation of energy when the toner is fixed to the OHP sheet S can be achieved. In the meantime, when the UV softening material contains the discotic liquid crystalline compound represented by General Formula (4) above, the UV softening material is solidified by the heated transfer roller 9A, so that the visible LED 16 does not have to emit visible light.

Further, also in the second embodiment as above, the same functions and effects as those of the above-described first embodiment can be exhibited.

6. Third Embodiment

Next, there will be explained a third embodiment of the present teaching.

Figure 6:
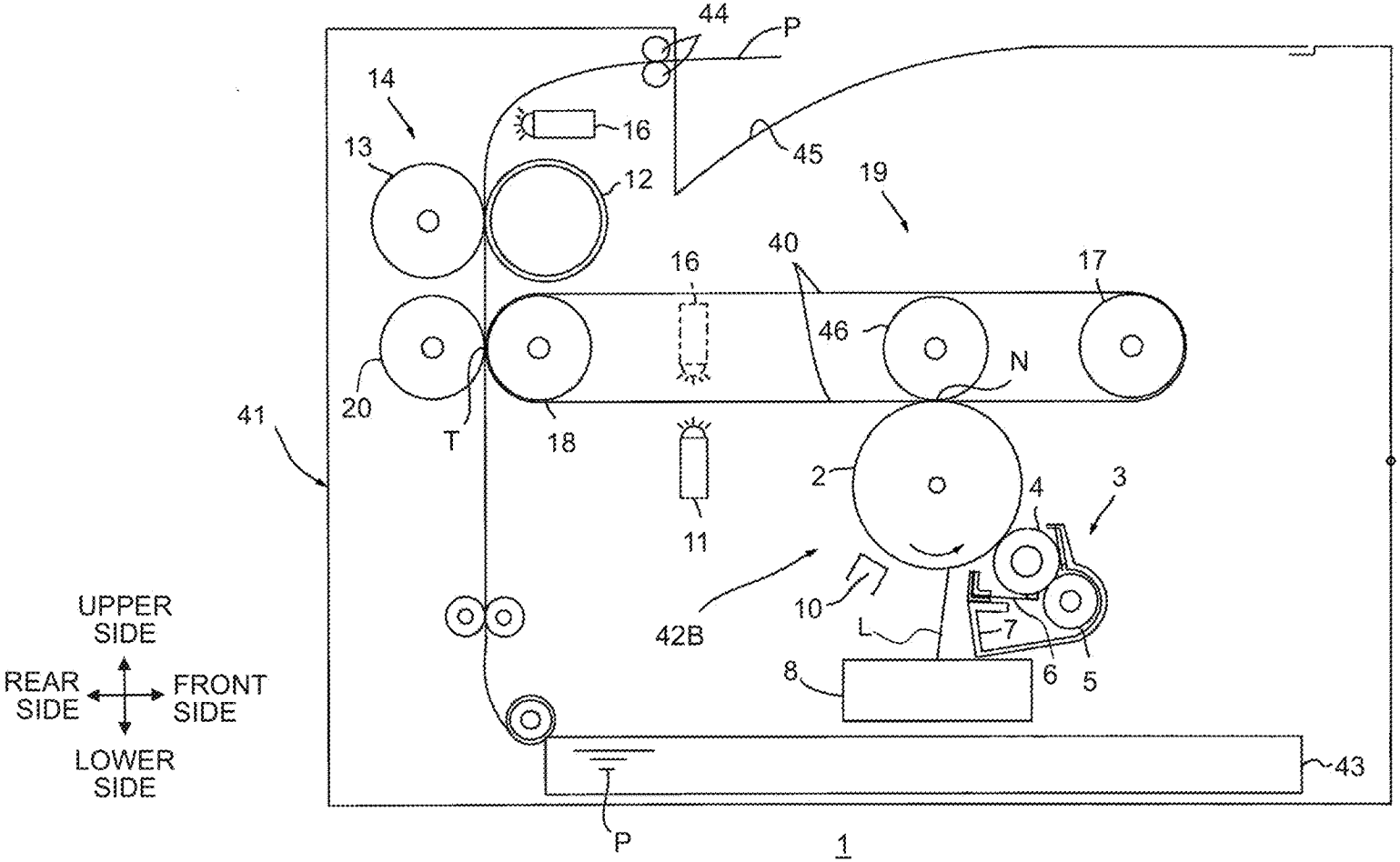
FIG. 6 is a central cross-sectional view of a printer as a third embodiment of the image forming apparatus of the present teaching.

FIG. 6 is a central cross-sectional view of a printer as the third embodiment of the image forming apparatus of the present teaching. In FIG. 6, to the parts corresponding to the respective parts shown in FIG. 1, the same reference numerals and symbols as those of the respective parts are given, and their explanations are omitted.

In the third embodiment of the present teaching, an image forming unit 42B includes: the photosensitive drum 2; the developing cartridge 3; the scanner unit 8; the scorotron charger 10; and an intermediate transfer unit 19.

The photosensitive drum 2 is formed to have a substantially cylindrical shape extending in the left-right direction, and is configured to rotate substantially counterclockwise as viewed on the left side.

The developing cartridge 3 is arranged on the front lower side of the photosensitive drum 2, and includes the casing 7.

Further, the developing cartridge 3 includes: the developing roller 4; the supply roller 5; and the layer thickness regulating blade 6 in the casing 7. The developing roller 4 is arranged to be exposed from the upper side of the casing 7, rotatably supported by the casing 7, and is in contact with the photosensitive drum 2 from the front lower side.

The supply roller 5 is arranged to press against the developing roller 4 from the front lower side, and is rotatably supported by the casing 7. The layer thickness regulating blade 6 is supported by the casing 7 to come into contact with the developing roller 4 from below. Then, the casing 7 accommodates the above-described toner under/below the layer thickness regulating blade 6 in the inside thereof.

The scanner unit 8 is arranged below the photosensitive drum 2 at a lower portion inside the main body casing 41. Further, the scanner unit 8 emits the laser beam L based on image data toward the photosensitive drum 2 to expose the circumferential surface of the photosensitive drum 2.

The scorotron charger 10 is opposingly arranged on the rear lower side of the photosensitive drum 2 with a space left therebetween.

The intermediate transfer unit 19 is arranged on the photosensitive drum 2, and includes: a driving roller 18; a driven roller 17; the intermediate transfer belt 40 as one example of an intermediate transfer member; a primary transfer roller 46; and a secondary transfer roller 20.

The driving roller 18 and the driven roller 17 are arranged opposingly to each other in the front-rear direction with a space left therebetween.

The intermediate transfer belt 40 is arranged on the photosensitive drum 2 so that a lower side portion thereof comes into contact with the photosensitive drum 2 from above, and is stretched around the driving roller 18 and the driven roller 17. Further, the intermediate transfer belt 40 is circumferentially moved by driving of the driving roller 18 and the following driving of the driven roller 17 so that the lower side portion to come into contact with the photosensitive drum 2 moves from the front side toward the rear side.

The primary transfer roller 46 is pressed against the photosensitive drum 2 from above so as to sandwich the lower side portion of the intermediate transfer belt 40 with the photosensitive drum 2. Thereby, the primary transfer roller 46 is arranged in the space surrounded by the intermediate transfer belt 40 when viewed in the left-right direction. Incidentally, a primary transfer bias is applied to the primary transfer roller 46 in the image forming operation.

The secondary transfer roller 20 is arranged in rear of the intermediate transfer belt 40 to face the driving roller 18 sandwiching the intermediate transfer belt 40 therebetween. Incidentally, a secondary transfer bias is applied to the secondary transfer roller 20 in the image forming operation.

A fixing unit 14 includes: the ultraviolet LED 11; the heating roller 12; the pressing roller 13; and the visible LED 16.

The ultraviolet LED 11 is arranged on the moving direction downstream side of the intermediate transfer belt 40 with respect to the nip position N being the position where the intermediate transfer belt 40 is sandwiched by the photosensitive drum 2 and the primary transfer roller 46. The ultraviolet LED 11 is arranged on the moving direction upstream side of the intermediate transfer belt 40 with respect to an abutting position T of the secondary transfer roller 20 and the intermediate transfer belt 40. That is, the ultraviolet LED 11 is arranged to expose the toner on the intermediate transfer belt 40 before being transferred onto the printing paper P. The ultraviolet LED 11 is arranged in rear of the photosensitive drum 2 with a space left therebetween, and is arranged below the intermediate transfer belt 40 with a space left therebetween. Further, the ultraviolet LED 11 is arranged to emit the above-described ultraviolet light toward the upper side.

The heating roller 12 is arranged above the driving roller 18 with a space left therebetween. The pressing roller 13 is pressed against the heating roller 12 from the rear side.

The visible LED 16 is arranged on the transporting direction downstream side of the printing paper P with respect to the abutting position of the pressing roller 13 and the heating roller 12. That is, the visible LED 16 is arranged to expose the toner image that has passed through the space between the pressing roller 13 and the heating roller 12. The visible LED 16 is arranged above the heating roller 12 with a space left therebetween. Further, the visible LED 16 is arranged to emit the above-described visible light toward the rear side.

In the third embodiment as above, in the image forming operation, the toner image carried on the surface of the photosensitive drum 2 is primarily transferred onto a lower surface of the lower side portion of the intermediate transfer belt 40 by a primary transfer bias of the primary transfer roller 46.

The toner image transferred onto the lower surface of the intermediate transfer belt 40 is transported by circumferential movement of the intermediate transfer belt 40 toward the position where the intermediate transfer belt 40 and the secondary transfer roller 20 face each other.

Then, the toner image transferred onto the intermediate transfer belt 40 passes above the ultraviolet LED 11. At this time, the ultraviolet light from the ultraviolet LED 11 is emitted to the toner image. That is, the ultraviolet LED 11 emits the above-described ultraviolet light to the toner image on the intermediate transfer belt 40. Thereby, the UV softening material positioned on the surface of the toner is melted to fusion-adhere to the surface of the intermediate transfer belt 40.

Next, by circumferential movement of the intermediate transfer belt 40, the toner image arrives at the position where the intermediate transfer belt 40 and the secondary transfer roller 20 face each other. Then, the toner image is brought to the contact position where the toner image comes into contact with the first surface being the driving roller 18 side of the printing paper P supplied from the paper feed tray 43.

At this time, the toner image existing at the contact position is transferred onto the first surface of the printing paper P by a secondary transfer bias applied to the secondary transfer roller 20 and viscosity of the UV softening material.

Next, the printing paper P is transported to the space between the heating roller 12 and the pressing roller 13, and is heated and pressed when passing through the space between the heating roller 12 and the pressing roller 13. Thereby, the melted UV softening material is pressed toward the first surface of the printing paper P and solidifies to adhere to the first surface of the printing paper P. Therefore, the toner image is fixed to the first surface of the printing paper P.

Next, when the toner image on the printing paper P arrives at the rear side of the visible LED 16, the visible light from the visible LED 16 is emitted to the toner image on the printing paper P. Thereby, when the UV softening material contains the sugar alcohol ester represented by General Formula (1) or General Formula (2) above, the melted UV softening material securely solidifies to adhere to the first surface of the printing paper P.

Thereafter, the printing paper P is discharged onto the paper discharge tray 45 formed on the upper surface of the main body casing 41 by the paper discharge rollers 44.

According to the third embodiment as above, the ultraviolet LED 11 exposes the toner image on the intermediate transfer belt 40, thereby making it possible to melt the UV softening material contained in the toner on the intermediate transfer belt 40.

Therefore, when the toner containing the melted UV softening material is transported by the intermediate transfer belt 40 to come into contact with the printing paper P, the toner image can be securely transferred onto the printing paper P. That is, in this embodiment, the UV softening material of the toner containing the UV softening material is not melted on the photosensitive drum 2. Therefore, smudges on the photosensitive drum 2 made by attachment of the UV softening material to the photosensitive drum 2 are prevented.

In this embodiment, the UV softening material is heated by the heating roller 12, but it is also possible that in place of heating the heating roller 12, the secondary transfer roller 20 is configured to be heatable and the UV softening material is heated by the secondary transfer roller 20. Further, when the UV softening material contains the sugar alcohol ester represented by General Formula (1) or General Formula (2) above, the melted UV softening material can be fully solidified only by the visible LED 16. Therefore, the heating roller 12 does not have to be configured to be heatable. In the meantime, when the UV softening material contains the discotic liquid crystalline compound represented by General Formula (4) above, the UV softening material is solidified by the heating roller 12, so that the visible LED 16 does not have to emit visible light and the visible LED 16 may also be eliminated.

As a result, simplification of the printer 1 can be achieved, and additionally, further conservation of energy when the toner is fixed to the printing paper P can be achieved.

Further, also in the third embodiment as above, the same functions and effects as those of the above-described first embodiment can be exhibited.

Further, in the third embodiment as above, as indicated by the virtual line in FIG. 6, the visible LED 16 can also be arranged in the inside around the intermediate transfer belt 40 when viewed in the left-right direction. In this case, the intermediate transfer belt 40 is formed of a material transmitting visible light having at least a wavelength of not less than 400 nm nor more than 800 nm, which is, for example, a well-known transparent resin material.

More specifically, the visible LED 16 is configured to emit the above-described visible light downward. Further, the visible LED 16 is arranged on the side opposite to the ultraviolet LED 11 with respect to the lower side portion of the intermediate transfer belt 40, and is arranged in the inside around the intermediate transfer belt 40 so as to face the upper surface of the lower side portion of the intermediate transfer belt 40. Further, the ultraviolet LED 11 and the visible LED 16 are arranged to overlap each other when projecting in the up-down direction.

According to this, since the visible LED 16 is arranged in the inside around the intermediate transfer belt 40, efficient arrangement of the visible LED 16 and the intermediate transfer belt 40 can be secured as compared to the case where the visible LED 16 is arranged outside the intermediate transfer belt 40.

Further, the visible LED 16 emits visible light to the intermediate transfer belt 40 side of the toner image on the intermediate transfer belt 40, namely the upper side portion of the toner image on the intermediate transfer belt 40 during the image forming operation. Therefore, of the toner image on the intermediate transfer belt 40, the UV softening material in the upper side portion in contact with the intermediate transfer belt 40 is solidified. As a result, it is possible to achieve an improvement in detachability of the toner image from the intermediate transfer belt 40 when the toner image is transferred onto the printing paper P from the intermediate transfer belt 40.

7. Forth Embodiment

Next, there will be explained a fourth embodiment of the present teaching.

Figure 7:
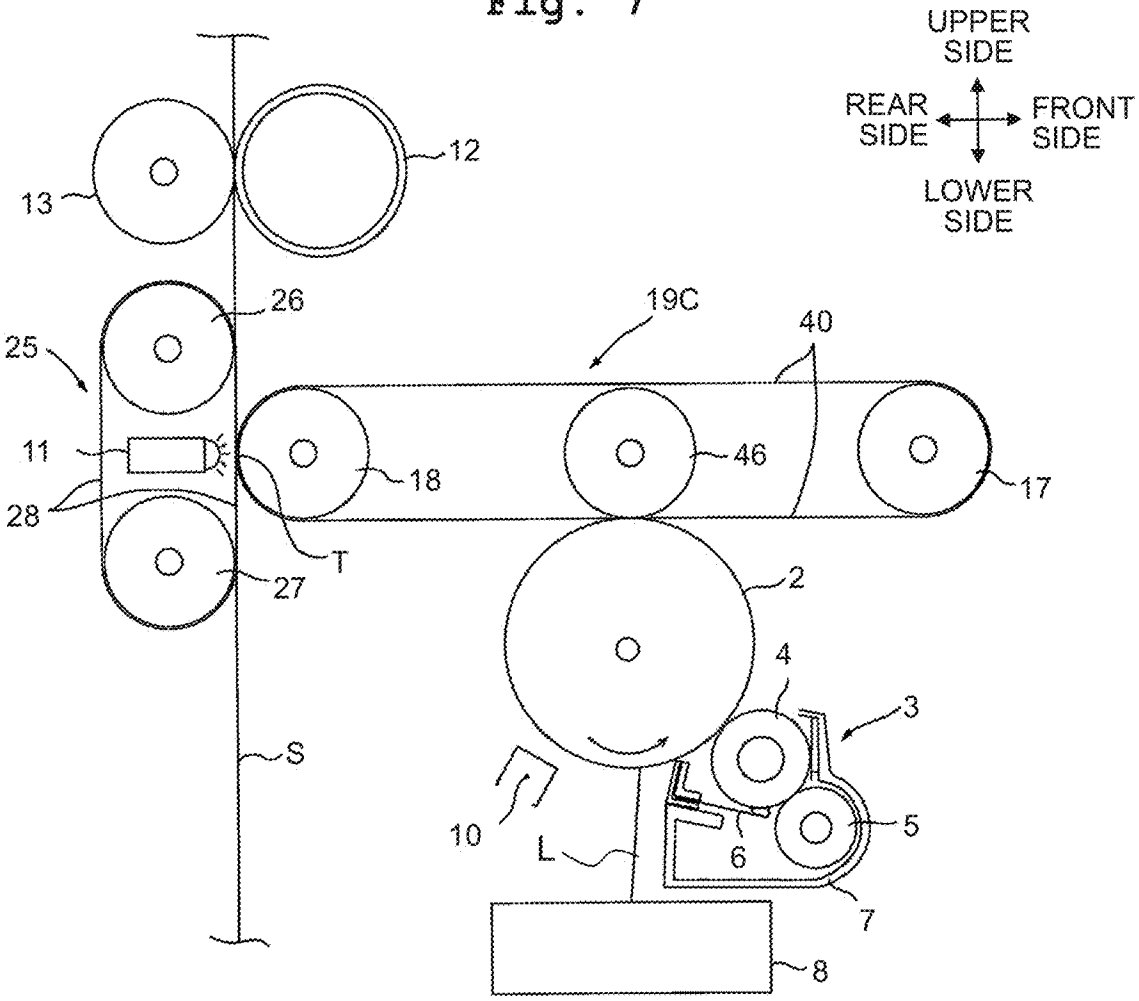
FIG. 7 is a central cross-sectional view of a printer as a fourth embodiment of the image forming apparatus of the present teaching.

FIG. 7 is a central cross-sectional view of a printer as the fourth embodiment of the image forming apparatus of the present teaching. In FIG. 7, to the parts corresponding to the respective parts shown in FIG. 1, FIG. 5, and FIG. 6, the same reference numerals and symbols as those of the respective parts are given, and their explanations are omitted.

In the third embodiment, the intermediate transfer unit 19 includes the secondary transfer roller 20, but in the fourth embodiment, in place of this, an intermediate transfer unit 19C includes a secondary transfer unit 25.

The secondary transfer unit 25 is arranged in rear of the driving roller 18, and includes: a driving roller 26; a driven roller 27; a transportation belt 28; and the ultraviolet LED 11.

The driving roller 26 and the driven roller 27 are arranged in the up-down direction with a space left therebetween. The transportation belt 28 is formed of a material transmitting ultraviolet light having at least a wavelength of 300 nm or more to less than 400 nm, and is formed of, for example, a well-known transparent resin material.

Further, the transportation belt 28 is stretched around the driving roller 26 and the driven roller 27 so that a front side portion thereof comes into contact with a rear end portion of the intermediate transfer belt 40 from the rear side. The transportation belt 28 is circumferentially moved by driving of the driving roller 26 and the following driving of the driven roller 27 so that the front side portion to come into contact with the driving roller 18 moves from the lower side toward the upper side in the image forming operation.

The ultraviolet LED 11 is arranged in the space surrounded by the transportation belt 28 when viewed in the left-right direction, and is arranged between the driving roller 26 and the driven roller 27 in the up-down direction. Further, the ultraviolet LED 11 is arranged to emit the above-described ultraviolet light forward toward an abutting position T where the intermediate transfer belt 40 and the transportation belt 28 abut each other. The ultraviolet LED 11 is arranged to emit the ultraviolet light toward the intermediate transfer belt 40 from the transportation belt 28 side with respect to the abutting position T.

In the fourth embodiment as above, in the image forming operation, the toner image transferred onto the intermediate transfer belt 40 is transported to the nip position of the intermediate transfer belt 40 and the transportation belt 28 by circumferential movement of the intermediate transfer belt 40. In the meantime, the OHP sheet S is fed to the space between the intermediate transfer belt 40 and the transportation belt 28 from the paper feed tray 43.

Thereby, the toner image, when arriving at the nip position of the intermediate transfer belt 40 and the transportation belt 28, is brought to the contact position where the toner image comes into contact with the first surface being the driving roller 18 side of the OHP sheet S.

At this time, the ultraviolet light from the ultraviolet LED 11 is emitted to the toner image existing at the contact position from the rear side. That is, the ultraviolet LED 11 emits the above-described ultraviolet light toward the toner image existing at the contact position. Thereby, the UV softening material is melted by the ultraviolet light emission from the ultraviolet LED 11.

Therefore, the toner image existing at the contact position is transferred onto the first surface of the OHP sheet S by viscosity of the UV softening material.

Next, the OHP sheet S is transported to the space between the heating roller 12 and the pressing roller 13 by circumferential movement of the transportation belt 28, and is heated and pressed when passing through the space between the heating roller 12 and the pressing roller 13. Thereby, the melted UV softening material is pressed toward the first surface of the OHP sheet S and solidifies to adhere to the first surface of the OHP sheet S. Therefore, the toner image is fixed to the first surface of the OHP sheet S. Incidentally, similarly to the third embodiment, the visible LED is provided on the transporting direction downstream side of the heating roller 12 and the pressing roller 13, but its illustration is omitted in FIG. 7. When the toner image on the OHP sheet S arrives at the visible LED, the visible light from the visible LED 16 is emitted to the toner image on the OHP sheet S. Thereby, when the UV softening material contains the sugar alcohol ester represented by General Formula (1) or General Formula (2) above, the melted UV softening material solidifies securely to adhere to the first surface of the OHP sheet S. In the meantime, when the UV softening material contains the discotic liquid crystalline compound represented by General Formula (4) above, the UV softening material is solidified by the heating roller 12, so that the visible LED does not have to emit visible light, and the visible LED 16 may also be eliminated. Incidentally, providing the transportation belt 28 makes it possible to prevent the printing paper from interfering with the ultraviolet LED 11 adjacently arranged on the rear side of the driving roller 18 at the time of printing paper transportation. Further, similarly to the above-described embodiments, the fourth embodiment may also be configured so that the visible LED 16 is arranged to expose the printing paper that has passed through the space between the heating roller 12 and the pressing roller 13.

Also in the fourth embodiment as above, the same functions and effects as those of the above-described first embodiment can be exhibited.

8. Fifth Embodiment

Next, there will be explained a fifth embodiment of the present teaching.

Figure 8:
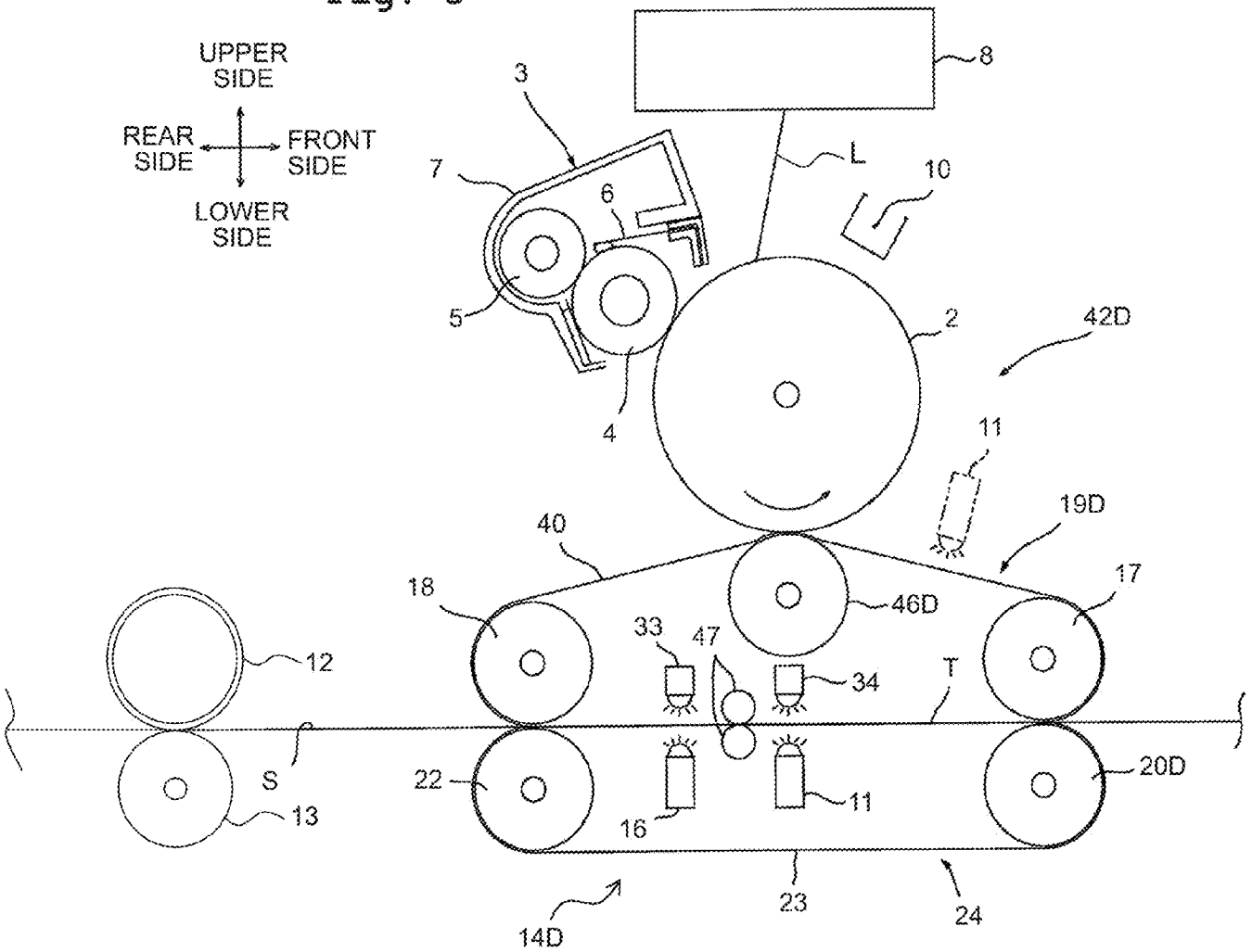
FIG. 8 is a central cross-sectional view of a printer as a fifth embodiment of the image forming apparatus of the present teaching.

FIG. 8 is a central cross-sectional view of a printer as the fifth embodiment of the image forming apparatus of the present teaching. In FIG. 8, to the parts corresponding to the respective parts shown in FIG. 1 and FIG. 5 to FIG. 7, the same reference numerals and symbols as those of the respective parts are given, and their explanations are omitted.

In the fifth embodiment of the present teaching, an image forming unit 42D includes: the photosensitive drum 2; the developing cartridge 3; the scanner unit 8; the scorotron charger 10; an intermediate transfer unit 19D; and a belt unit 24.

The photosensitive drum 2 is formed to have a substantially cylindrical shape extending in the left-right direction, and is configured to rotate substantially counterclockwise as viewed on the left side.

The developing cartridge 3 is arranged on the rear upper side of the photosensitive drum 2, and includes the casing 7. Further, the developing cartridge 3 includes: the developing roller 4; the supply roller 5; and the layer thickness regulating blade 6 in the casing 7. The developing roller 4 is arranged to be exposed from the front lower side of the casing 7, rotatably supported by the casing 7, and is in contact with the photosensitive drum 2 from the rear upper side.

The supply roller 5 is arranged to press against the developing roller 4 from the rear upper side, and is rotatably supported by the casing 7. The layer thickness regulating blade 6 is supported by the casing 7 to come into contact with the developing roller 4 from above. Then, the casing 7 accommodates the above-described toner on/above the layer thickness regulating blade 6 in the inside thereof.

The scanner unit 8 is arranged above the photosensitive drum 2 at an upper portion inside the main body casing 41. The scorotron charger 10 is opposingly arranged on the front upper side of the photosensitive drum 2 with a space left therebetween.

The intermediate transfer unit 19D is arranged under the photosensitive drum 2, and includes: the driving roller 18; the driven roller 17; a primary transfer roller 46D; and the intermediate transfer belt 40.

The primary transfer roller 46D is arranged on the front upper side of the driving roller 18 and on the rear upper side of the driven roller 17. Further, the primary transfer roller 46D is arranged under the photosensitive drum 2 so as to sandwich the upper side portion of the intermediate transfer belt 40 with the photosensitive drum 2.

The intermediate transfer belt 40 is arranged under the photosensitive drum 2 so that the upper side portion thereof comes into contact with the photosensitive drum 2 from below, and is stretched around the driving roller 18, the driven roller 17, and the primary transfer roller 46D. Thereby, the upper side portion of the intermediate transfer belt 40 is formed to have a substantially V shape with a top portion directing upward as viewed in a side view. Further, the intermediate transfer belt 40 is formed of a material transmitting ultraviolet light having a wavelength of 300 nm or more to less than 400 nm and transmitting visible light having a wavelength of not less than 400 nm nor more than 800 nm, which is, for example, a well-known transparent resin material.

Then, the intermediate transfer belt 40 is circumferentially moved by driving of the driving roller 18 and the following driving of the driven roller 17 so that the upper side portion to come into contact with the photosensitive drum 2 moves from the rear side toward the front side.

The belt unit 24 is arranged under the intermediate transfer unit 19D, and includes: a driving roller 22; a secondary transfer roller 20D; and a transportation belt 23.

The driving roller 22 is arranged under the driving roller 18, and is in contact with the driving roller 18 via the intermediate transfer belt 40 and the transportation belt 23. Further, the secondary transfer roller 20D is arranged under the driven roller 17, and is in contact with the driven roller 17 via the intermediate transfer belt 40 and the transportation belt 23. Thereby, the lower side portion of the intermediate transfer belt 40 and the upper side portion of the transportation belt 23 are in contact with each other.

The transportation belt 23 is arranged under the intermediate transfer unit 19D so that the upper side portion thereof comes into contact with the intermediate transfer belt 40 from below, and is stretched around the driving roller 22 and the secondary transfer roller 20D. Further, the transportation belt 23 is formed of a material transmitting ultraviolet light having a wavelength of 300 nm or more to less than 400 nm and transmitting visible light having a wavelength of not less than 400 nm nor more than 800 nm, which is, for example, a well-known transparent resin material.

Then, the transportation belt 23 is circumferentially moved by driving of the driving roller 22 and the following driving of the secondary transfer roller 20D so that the upper side portion to come into contact with the intermediate transfer belt 40 moves from the front side toward the rear side.

A fixing unit 14D includes: the ultraviolet LED 11; the visible LED 16; a sub-ultraviolet LED 34 as one example of a third exposure device; a sub-visible LED 33 as one example of a fourth exposure device; and a pair of pinch rollers 47 as one example of the pressing member.

The ultraviolet LED 11 is arranged in the space surrounded by the transportation belt 23 when viewed in the left-right direction, and is arranged between the driving roller 22 and the secondary transfer roller 20D in the front-rear direction. The ultraviolet LED 11 is arranged on the downstream side of the secondary transfer roller 20D and on the upstream side of the pinch rollers 47 in the moving direction of the transportation belt 23 at an abutting position T where the intermediate transfer belt 40 and the transportation belt 23 abut each other. Further, the ultraviolet LED 11 is arranged below the portion where the intermediate transfer belt 40 and the transportation belt 23 abut each other, with a space left therebetween. The ultraviolet LED 11 is arranged to emit the above-described ultraviolet light upward. That is, the ultraviolet LED 11 is arranged to emit the ultraviolet light toward the intermediate transfer belt 40 from the transportation belt 23 side with respect to the abutting position T where the intermediate transfer belt 40 and the transportation belt 23 abut each other.

The visible LED 16 is arranged in the space surrounded by the transportation belt 23 when viewed in the left-right direction, and is arranged between the driving roller 22 and the ultraviolet LED 11 in the front-rear direction. The visible LED 16 is arranged on the downstream side of the pinch rollers 47 and on the upstream side of the driving roller 22 in the moving direction of the transportation belt 23 at the abutting position T where the intermediate transfer belt 40 and the transportation belt 23 abut each other. Further, the visible LED 16 is arranged below the portion where the intermediate transfer belt 40 and the transportation belt 23 abut each other, with a space left therebetween. The visible LED 16 is arranged to emit the above-described visible light upward. That is, the visible LED 16 is arranged to emit the visible light toward the intermediate transfer belt 40 from the transportation belt 23 side with respect to the abutting position T where the intermediate transfer belt 40 and the transportation belt 23 abut each other.

The sub-ultraviolet LED 34 is arranged in the inside around the intermediate transfer belt 40 when viewed in the left-right direction, and is arranged between the driving roller 18 and the driven roller 17 and below the primary transfer roller 46D in the front-rear direction. The sub-ultraviolet LED 34 is arranged on the downstream side of the driven roller 17 in the moving direction of the intermediate transfer belt 40 at the abutting position T where the intermediate transfer belt 40 and the transportation belt 23 abut each other. The sub-ultraviolet LED 34 is arranged on the upstream side of the pinch rollers 47 in the moving direction of the intermediate transfer belt 40 at the abutting position T where the intermediate transfer belt 40 and the transportation belt 23 abut each other. Further, the sub-ultraviolet LED 34 is arranged above the portion where the intermediate transfer belt 40 and the transportation belt 23 abut each other, with a space left therebetween. Further, the sub-ultraviolet LED 34 is arranged to overlap the ultraviolet LED 11 when projecting in the up-down direction, and is configured to emit ultraviolet light having the same wavelength as that of the ultraviolet light that the ultraviolet LED 11 emits, specifically, the ultraviolet light having a wavelength of 300 nm or more to less than 400 nm downward. That is, the sub-ultraviolet LED 34 is arranged to emit ultraviolet light toward the transportation belt 23 from the intermediate transfer belt 40 side with respect to the abutting position T where the intermediate transfer belt 40 and the transportation belt 23 abut each other.

The sub-visible LED 33 is arranged in the space surrounded by the intermediate transfer belt 40 when viewed in the left-right direction, and is arranged between the driving roller 18 and the sub-ultraviolet LED 34 in the front-rear direction. The sub-visible LED 33 is arranged on the downstream side of the pinch rollers 47 and on the upstream side of the driving roller 18 in the moving direction of the intermediate transfer belt 40 at the abutting position T where the intermediate transfer belt 40 and the transportation belt 23 abut each other. Further, the sub-visible LED 33 is arranged above the lower side portion of the intermediate transfer belt 40 with a space left therebetween. Further, the sub-visible LED 33 is arranged to overlap the visible LED 16 when projecting in the up-down direction, and is configured to emit visible light having the same wavelength as that of the visible light that the visible LED 16 emits, specifically, the visible light having a wavelength of not less than 400 nm nor more than 800 nm downward. That is, the sub-visible LED 33 is arranged to emit visible light toward the transportation belt 23 from the intermediate transfer belt 40 side with respect to the abutting position T where the intermediate transfer belt 40 and the transportation belt 23 abut each other.

The paired pinch rollers 47 are opposingly arranged in the up-down direction so as to sandwich the lower side portion of the intermediate transfer belt 40 and the upper side portion of the transportation belt 23 therebetween. More specifically, one of the pair of pinch rollers 47 on the upper side is arranged in the space surrounded by the intermediate transfer belt 40 when viewed in the left-right direction, and is arranged between the sub-visible LED 33 and the sub-ultraviolet LED 34 in the front-rear direction. The other of the pair of pinch rollers 47 on the lower side is arranged in the space surrounded by the transportation belt 23 when viewed in the left-right direction, and is arranged between the visible LED 16 and the ultraviolet LED 11 in the front-rear direction.

In the fifth embodiment as above, in the image forming operation, the toner image transferred onto the intermediate transfer belt 40 is transported toward a contact portion of the driven roller 17 and the secondary transfer roller 20D by circumferential movement of the intermediate transfer belt 40. In the meantime, the OHP sheet S is fed to the space between the driven roller 17 and the secondary transfer roller 20D from the paper feed tray 43.

Thereby, the toner image, when arriving at the contact portion of the driven roller 17 and the secondary transfer roller 20D, is brought to the contact position where the toner image comes into contact with the first surface being the intermediate transfer belt 40 side of the OHP sheet S.

At this time, the toner image existing at the contact position is transferred onto the first surface of the OHP sheet S from the intermediate transfer belt 40 by a secondary transfer bias of the secondary transfer roller 20D.

Next, the OHP sheet S onto which the toner image has been transferred is moved from the front side toward the rear side by circumferential movements of the intermediate transfer belt 40 and the transportation belt 23. Then, the OHP sheet S arrives at the space between the ultraviolet LED 11 and the sub-ultraviolet LED 34. That is, the toner image arrives at the space between the ultraviolet LED 11 and the sub-ultraviolet LED 34 while the state of the toner image which is at the contact position where the toner image comes into contact with the first surface of the OHP sheet S being maintained.

Then, the ultraviolet LED 11 emits ultraviolet light toward the toner image existing at the contact position from below and the sub-ultraviolet LED 34 emits ultraviolet light toward the toner image existing at the contact position from above. That is, ultraviolet light is emitted to the toner image existing at the contact position from both the upper and lower sides. Incidentally, the ultraviolet LED 11 is arranged on the side opposite to the photosensitive drum 2 with respect to the toner image existing at the contact position, and the sub-ultraviolet LED 34 is arranged on the side opposite to the ultraviolet LED 11 with respect to the toner image existing at the contact position when viewed in the left-right direction.

Thereby, the UV softening material is melted by the individual ultraviolet light emissions from the ultraviolet LED 11 and the sub-ultraviolet LED 34. Therefore, the UV softening material fusion-adheres to the first surface of the OHP sheet S.

Next, the OHP sheet S is transported toward the space between the pair of pinch rollers 47 by circumferential movements of the intermediate transfer belt 40 and the transportation belt 23. Then, the toner image transferred onto the OHP sheet S is pressed while the OHP sheet S is passing through the space between the pair of pinch rollers 47. Thereby, the toner image adheres closely to the first surface of the OHP sheet S.

Further, when the OHP sheet S is transported rearward, the toner image arrives at the space between the visible LED 16 and the sub-visible LED 33. Then, the visible LED 16 emits visible light toward the toner image existing at the contact position from below and the sub-visible LED 33 emits visible light toward the toner image existing at the contact position from above. That is, visible light is emitted toward the toner image existing at the contact position from both the upper and lower sides. Incidentally, the visible LED 16 is arranged on the side opposite to the photosensitive drum 2 with respect to the toner image existing at the contact position, and the sub-visible LED 33 is arranged on the side opposite to the visible LED 16 with respect to the toner image existing at the contact position when viewed in the left-right direction.

Thereby, the melted UV softening material solidifies to adhere to the first surface of the OHP sheet S. Therefore, the toner image is fixed to the first surface of the OHP sheet S.

According to the fifth embodiment as above, the pair of pinch rollers 47 presses the OHP sheet S holding the toner image exposed by the ultraviolet LED 11 thereon. Therefore, it is possible to make the toner image adhere closely to the OHP sheet S, and further it is possible to achieve an improvement in fixation of the toner image to the OHP sheet S.

Further, the belt unit 24 includes the secondary transfer roller 20D, thereby making it possible to securely transfer the toner image on the intermediate transfer belt 40 onto the OHP sheet S from the intermediate transfer belt 40.

Further, the ultraviolet LED 11 emits ultraviolet light toward the toner image existing at the contact position, thereby making it possible to melt the UV softening material contained in the toner existing at the contact position. Therefore, it is possible to make the UV softening material contained in the toner fusion-adhere to the OHP sheet S securely.

Further, the ultraviolet LED 11 and the sub-ultraviolet LED 34 emit the ultraviolet light having a wavelength of 300 nm or more to less than 400 nm to the toner image existing at the contact position from both the upper and lower sides respectively.

Therefore, it is possible to melt the UV softening material contained in the toner securely, and furthermore, it is possible to achieve an improvement in fixation of the toner image to the OHP sheet S securely.

Further, the visible LED 16 and the sub-visible LED 33 emit the visible light having a wavelength of not less than 400 nm nor more than 800 nm from both the upper and lower sides respectively. That is, to the toner containing the UV softening material melted by the ultraviolet light emissions, the visible light having a wavelength of not less than 400 nm nor more than 800 nm is emitted from both the upper and lower sides.

Therefore, it is possible to solidify the UV softening material contained in the toner securely, and furthermore it is possible to achieve an improvement in fixation of the toner image to the OHP sheet S more securely. Further, the sub-visible LED 33 and the sub-ultraviolet LED 34 are arranged in the inside around the intermediate transfer belt 40, and the visible LED 16 and the ultraviolet LED 11 are arranged in the inside around the transportation belt 23, thereby making it possible to prevent interference between the printing paper to be transported and each of the LEDs. Incidentally, when the UV softening material contains the discotic liquid crystalline compound represented by General Formula (4) above, it is possible to heat and solidify the UV softening material by the heating roller 12 arranged on the transporting direction downstream side of the belt unit 24 and the intermediate transfer unit 19D. When the UV softening material is heated and solidified by the heating roller 12, the visible LED does not have to emit visible light and the visible LED 16 may also be eliminated.

Also in the fifth embodiment as above, the same functions and effects as those of the above-described first embodiment can be exhibited.

Further, in the fifth embodiment as above, as indicated by the virtual line in FIG. 8, the ultraviolet LED 11 may also be arranged to face the front side portion in the upper side portion of the intermediate transfer belt 40 with a space left therebetween in front of the photosensitive drum 2.

In this case, the ultraviolet LED 11 is arranged to emit the above-described ultraviolet light to the rear lower side. Further, the secondary transfer roller 20D is configured so that a circumferential surface thereof is heated to, for example, 25 to 100° C. and preferably 40 to 80° C. That is, the secondary transfer roller 20D works as the heating member and the pressing member (functions not only as the heating member but also as the pressing member).

In such a case, in the image forming operation, the toner image transferred onto the intermediate transfer belt 40 is exposed by the ultraviolet LED 11 before arriving at the space between the driven roller 17 and the secondary transfer roller 20D. Then, the UV softening material contained in the toner is melted.

Then, when the toner image on the intermediate transfer belt 40 and the OHP sheet S both arrive at the space between the driven roller 17 and the secondary transfer roller 20D and the toner image is brought to the contact position, the toner image is transferred onto the first surface of the OHP sheet S from the intermediate transfer belt 40 by the secondary transfer roller 20D and viscosity of the UV softening material. Further, the toner image and the OHP sheet S, when passing through the space between the driven roller 17 and the secondary transfer roller 20D, are heated and pressed.

Therefore, the melted UV softening material is pressed toward the first surface of the OHP sheet S and solidifies to adhere to the first surface of the OHP sheet S. As a result, the toner image is fixed to the first surface of the OHP sheet S.

According to this, the secondary transfer roller 20D works also as the heating member, therefore being able to securely solidify the UV softening material contained in the toner while being able to transfer the toner onto the OHP sheet S from the intermediate transfer belt 40.

Further, the secondary transfer roller 20D works also as the pressing member, therefore being able to make the UV softening material contained in the toner adhere closely to the OHP sheet S securely while being able to transfer the toner onto the OHP sheet S from the intermediate transfer belt 40.

9. Modified Embodiment

The above-described printer 1 is one embodiment of the image forming apparatus of the present teaching, and the present teaching is not limited to the above-described first embodiment to fifth embodiment.

The image forming apparatus of the present teaching can also be configured as a color printer, in addition to the above-described monochrome printer.

When the image forming apparatus is configured as a color printer, the image forming apparatus can be configured as a direct system tandem type color printer including a plurality of photosensitive members and a recording medium transporting member, or an intermediate transfer system tandem type color printer including a plurality of photosensitive members, an intermediate transfer member, and a transfer member.

Further, in the above-described first embodiment to fifth embodiment, the visible LED 16 is included as shown in FIG. 1, and FIG. 5 to FIG. 8, but when the toner contains the discotic liquid crystalline compound represented by General Formula (4), the melted UV softening material solidifies by heating, and therefore the visible LED 16 does not have to be included.

However, in the first to fifth embodiments each including the visible LED 16, it is possible to achieve an improvement in solidification speed of the melted UV softening material, and furthermore it is possible to achieve an improvement in printing speed of the printer 1 as compared to an aspect not including the visible LED 16.

Further, in the above-described fifth embodiment, the sub-visible LED 33 and the sub-ultraviolet LED 34 are included as shown in FIG. 8, but in the fifth embodiment, the sub-visible LED 33 and the sub-ultraviolet LED 34 do not have to be included.

By this as well, the same functions and effects as those of the above-described first embodiment to fourth embodiment can be exhibited.

Further, in the above-described first embodiment to fifth embodiment, the photosensitive drum 2 is included as one example of the photosensitive member, but the photosensitive member is not limited to this, and may also be, for example, a photosensitive member belt or the like.

Further, in above-described first embodiment to fifth embodiment, as the transfer member, the roller members such as the transfer rollers 9 and 9A, the primary transfer rollers 46 and 46D, and the secondary transfer rollers 20 and 20D are included, but the transfer member is not limited to these when the transfer member does not work as the pressing member, and the transfer member may also be, for example, a non-contact type transfer device such as a corona discharge type transfer device.

Further, in the above-described first embodiment to fifth embodiment, the ultraviolet LED 11 is included as one example of the first exposure device, and the visible LED 16 is included as one example of the second exposure device, but the first exposure device and the second exposure device are not limited to these, and each may also be an optical scanning device configured to scan a developer image by a polygon mirror or a galvano-mirror, for example.

Further, in the printers 1 in the first embodiment to the fifth embodiment, the cartridge in which the developer is accommodated is included, but the image forming apparatus of the present teaching can be handled in a state where the developer is not included yet, (which means an object to be sold, for example), and does not have to include the developer. That is, an image forming apparatus capable of forming an image using such a developer that contains the compound causing cis-trans isomerization reaction by light absorption to induce phase transition as specified in this specification is also included in the present teaching.

In the above, the present teaching has been explained specifically by the embodiments, but the present teaching is not limited to these. Incidentally, these first embodiment to fifth embodiment, and a modified example each can be combined appropriately.

INDUSTRIAL APPLICABILITY

In the image forming apparatus of the present teaching, it is possible to achieve power saving in a fixing process during image formation and simplify the configuration of the apparatus.

What is claimed is:

1. An image forming apparatus comprising:

a photosensitive member configured to transport a developer containing a compound that causes cis-trans isomerization reaction by light absorption to induce phase transition;

a first exposure device configured to emit ultraviolet light having a wavelength of 300 nm or more to less than 400 nm to a developer image; and a pressing member configured to press a recording sheet holding a developer image exposed by the first exposure device thereon, wherein the first exposure device is configured to expose the developer image transferred onto the recording sheet.

2. The image forming apparatus according to claim 1, further comprising:

a second exposure device configured to emit visible light having a wavelength of not less than 400 nm nor more than 800 nm to the developer image to which the ultraviolet light has been emitted.

3. An image forming apparatus comprising:

a photosensitive member configured to transport a developer containing a compound that causes cis-trans isomerization reaction by light absorption to induce phase transition;

a first exposure device configured to emit ultraviolet light having a wavelength of 300 nm or more to less than 400 nm to a developer image;

a pressing member configured to press a recording sheet holding a developer image exposed by the first exposure device thereon; and a transportation belt for transporting a recording sheet, wherein the transportation belt is formed of a material transmitting the ultraviolet light.

4. An image forming apparatus comprising:

a photosensitive member configured to transport a developer containing a compound that causes cis-trans isomerization reaction by light absorption to induce phase transition;

a first exposure device configured to emit ultraviolet light having a wavelength of 300 nm or more to less than 400 nm to a developer image;

a pressing member configured to press a recording sheet holding a developer image exposed by the first exposure device thereon; and an intermediate transfer member configured to transport a developer image on the photosensitive member to the recording sheet, wherein the first exposure device is configured to expose a developer image on the intermediate transfer member.

5. The image forming apparatus according to claim 4, further comprising:

a second exposure device configured to emit visible light having a wavelength of not less than 400 nm nor more than 800 nm to the developer image to which the ultraviolet light has been emitted.

6. The image forming apparatus according to claim 5, wherein the second exposure device is configured to expose a developer image on the intermediate transfer member from the inside of a space surrounded by the intermediate transfer member.

7. The image forming apparatus according to claim 6, wherein the second exposure device is provided in the space surrounded by the intermediate transfer member so as to face a surface, of the intermediate transfer member, on the side opposite to a surface onto which the developer image is transferred.

8. The image forming apparatus according to claim 1, further comprising:

a heating member configured to heat a developer image transferred onto the recording sheet to fix the developer image to the recording sheet.

9. The image forming apparatus according to claim 1, further comprising:

a transfer member configured to transfer a developer image on the photosensitive member onto the recording sheet from the photosensitive member, wherein the first exposure device is arranged on the upstream side in a transporting direction in which a recording sheet is transported with respect to a contact position where the developer image and the recording sheet come into contact with each other, and is configured to emit ultraviolet light toward the contact position.

10. The image forming apparatus according to claim 9, further comprising:

a second exposure device configured to emit visible light having a wavelength of not less than 400 nm nor more than 800 nm to the developer image to which the ultraviolet light has been emitted and arranged on the downstream side in the transporting direction in which a recording sheet is transported with respect to the contact position, wherein the second exposure device is configured to emit visible light toward the contact position.

11. The image forming apparatus according to claim 1, further comprising:

an intermediate transfer member configured to transport a developer image on the photosensitive member to the recording sheet; and a transfer member facing the intermediate transfer member and configured to transfer a developer image on the intermediate transfer member onto a recording sheet, wherein the first exposure device is arranged on the side opposite to the photosensitive member with respect to the recording sheet.

12. The image forming apparatus according to claim 11, further comprising:

a third exposure device configured to emit ultraviolet light having a wavelength of 300 nm or more to less than 400 nm to a developer image, wherein the third exposure device is arranged on the side opposite to the first exposure device with respect to the recording sheet.

13. The image forming apparatus according to claim 11, further comprising:

a second exposure device configured to emit visible light having a wavelength of not less than 400 nm nor more than 800 nm to the developer image to which the ultraviolet light has been emitted.

14. The image forming apparatus according to claim 13, further comprising:

a fourth exposure device configured to emit visible light having a wavelength of not less than 400 nm nor more than 800 nm to the developer image to which the ultraviolet light has been emitted, wherein the second exposure device is arranged on the side opposite to the photosensitive member with respect to the recording sheet, and the fourth exposure device is arranged on the side opposite to the second exposure device with respect to the recording sheet.

15. The image forming apparatus according to claim 9, further comprising:

a heating member configured to heat a developer image to be transferred onto the recording sheet to fix the developer image to the recording sheet.

16. The image forming apparatus according to claim 15, wherein the transfer member includes a heating mechanism to function as the heating member.

17. The image forming apparatus according to claim 9, wherein the transfer member functions as the pressing member.

18. The image forming apparatus according to claim 17, further comprising:

a heating member configured to heat a developer image transferred onto the recording sheet to fix the developer image to the recording sheet.

19. The image forming apparatus according to claim 18, further comprising:

an intermediate transfer member configured to transport a developer image on the photosensitive member, wherein the first exposure device is configured to expose a developer image on the intermediate transfer member.

20. The image forming apparatus according to claim 18, further comprising:

a transfer member configured to transfer a developer image on the photosensitive member onto the recording sheet from the photosensitive member, wherein the first exposure device is arranged on the side opposite to the photosensitive member with respect to the recording sheet.

21. The image forming apparatus according to claim 20, wherein the transfer member includes a heating mechanism to function as the heating member.

22. The image forming apparatus according to claim 20, wherein the transfer member functions as the pressing member.

23. The image forming apparatus according to claim 1, further comprising:

a developer containing a compound causing cis-trans isomerization reaction by light absorption to induce phase transition.

24. The image forming apparatus according to claim 1, wherein the developer contains, a binder resin, a colorant, and an additive, and the additive contains the compound.

25. The image forming apparatus according to claim 1, wherein the developer contains a binder resin and a colorant, and the binder resin contains the compound.

26. The image forming apparatus according to claim 24, wherein the compound is a sugar alcohol ester.

27. The image forming apparatus according to claim 24, wherein the compound is a discotic liquid crystalline compound.

* * * * *